US008657425B2

(12) United States Patent
Kanbe et al.

(10) Patent No.: US 8,657,425 B2
(45) Date of Patent: Feb. 25, 2014

(54) INK CARTRIDGE AND INK SUPPLY DEVICE

(75) Inventors: Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 73 days.

(21) Appl. No.: 13/284,656

(22) Filed: Oct. 28, 2011

(65) Prior Publication Data

US 2012/0162325 A1 Jun. 28, 2012

(30) Foreign Application Priority Data

Dec. 27, 2010 (JP) ..... 2010-289332
Dec. 27, 2010 (JP) ..... 2010-289333
Dec. 27, 2010 (JP) ..... 2010-289335

(51) Int. Cl.
*B41J 2/175* (2006.01)

(52) U.S. Cl.
USPC ..... 347/86; 347/7; 347/19; 73/293

(58) Field of Classification Search
None
See application file for complete search history.

(56) References Cited

U.S. PATENT DOCUMENTS 5,852,946 A * 12/1998 Cowger ..... 73/293
6,012,795 A 1/2000 Saito et al.
6,286,921 B1 9/2001 Ochi et al.
6,312,083 B1 * 11/2001 Moore ..... 347/19
6,767,075 B1 * 7/2004 Takada et al. ..... 347/19
7,780,259 B2 * 8/2010 Hayamizu et al. ..... 347/19
8,348,363 B2 * 1/2013 Yamamoto ..... 347/7
2006/0203053 A1 9/2006 Katsumura
2007/0165053 A1 7/2007 Oguri
2010/0265305 A1 10/2010 Qin et al.

FOREIGN PATENT DOCUMENTS

EP 2193922 A1 6/2010
EP 2233296 A1 9/2010
JP H05-332812 A 12/1993
JP H06-286160 A 10/1994
JP H08-043174 A 2/1996
JP 2005-313448 A 11/2005
JP 2006-248201 A 9/2006
JP 2009-132098 A 6/2009

OTHER PUBLICATIONS

European Patent Office, extended European Search Report for European Patent Application No. 11185596.1, dated Apr. 26, 2012.

* cited by examiner

*Primary Examiner* — Henok Legesse
(74) *Attorney, Agent, or Firm* — Baker Botts L.L.P.

(57) ABSTRACT

An ink cartridge includes a case, an ink supply opening, and a light transmissive member positioned in the case and facing the ink supply opening. The light transmissive member is configured to allow light entering via the ink supply opening to pass therethrough. The light transmissive member includes a reflective surface having a first reflectance for light entering via the ink supply opening and passing through the light transmissive member when the reflective surface contacts ink stored in the ink chamber. The reflective surface has a second reflectance for light entering via the ink supply opening and passing through the light transmissive member when the reflective surface does not contact ink stored in the ink chamber. The first reflectance is different from the second reflectance.

25 Claims, 26 Drawing Sheets

INK CARTRIDGE AND INK SUPPLY DEVICE

CROSS REFERENCE TO RELATED APPLICATION

The Present application claims priority to and the benefit of Japanese Application No. JP-2010-289332, which was filed on Dec. 27, 2010; Japanese Application No. JP-2010-289333, which was filed on Dec. 27, 2010; and Japanese Application No. JP-2010-289335, which was filed on Dec. 27, 2010, the disclosures of which are incorporated herein by reference in their entirety.

BACKGROUND OF THE INVENTION

1. Field of the Invention

The present invention relates to an ink cartridge and an ink supply device comprising a cartridge mounting portion to which the ink cartridge is configured to be mounted.

2. Description of Related Art

A known image recording apparatus, as described in Patent Application Publication No. JP 2009-132098 A, includes a tube-supply system which has an ink cartridge positioned outside of a carriage carrying a recording head. The ink cartridge and the recording head are connected via a flexible tube. The known image recording apparatus has a cartridge mounting portion having an opening at the front of the image recording apparatus, and the ink cartridge is configured to be mounted to the cartridge mounting portion via the opening in a horizontal direction. The cartridge mounting portion is configured to removably receive the ink cartridge. When the ink cartridge is mounted to the cartridge mounting portion, an ink path is formed between the ink cartridge and the recording head via the flexible tube. Ink is supplied from the ink cartridge to the recording head via the ink path.

A known technique for determining an ink amount stored in an ink cartridge by optical means is described in Patent Application Publication No. JP H05-332812 A and U.S. Pat. No. 6,012,795 A. For example, a image recording apparatus has an ink cartridge, and the ink cartridge has a wall in which a light-transmissive plate is provided. When the inner surface of the light-transmissive plate contacts ink stored in the ink cartridge, the light-transmissive plate allows light to pass therethrough to reach the ink. When the inner surface of the light-transmissive plate does not contact ink, light is reflected totally at the inner surface of the light-transmissive plate. By detecting whether light emitted from a light emitter is reflected totally at the light-transmissive plate, the ink amount stored in the ink cartridge is determined.

Another known image recording apparatus, as described in Patent Application Publication No. JP H08-043174 A, has an ink cartridge in which light-wave guiding path is provided. By detecting the intensity of light entering the light-wave guiding path from one end of the light-wave guiding path and exiting the light-wave path from the other end of the light-wave guiding path, the ink amount stored in the ink cartridge is determined.

SUMMARY OF THE INVENTION

When determining the ink amount, it is desirable that the determination is performed immediately after the ink amount stored in the ink cartridge becomes zero. Nevertheless, in the aforementioned known methods, the detection of whether light is totally reflected or the detection of intensity of light are performed before the ink amount stored in the ink cartridge becomes zero, i.e., when the ink cartridge has some usable amount of ink stored therein. Thus, the determination that the ink amount has become zero is performed by calculating and estimating an amount of ink consumed after the aforementioned detection is performed. Nevertheless, due to estimation errors, the ink amount may not be determined to be zero even when the ink amount actually has become zero. Thus, there is a risk that image recording is attempted even after the ink amount has become zero. To avoid this risk, a state in which a small amount of ink still is left in the ink cartridge is equated with the state in which the ink amount has become zero, and a user is requested to replace the ink cartridge even with a reduced amount of ink still remains in the ink cartridge.

In order to consume ink stored in the ink cartridge efficiently, it is desirable that the optical detection for the determination of ink amount is performed when the amount of ink left in the ink cartridge is about zero.

Moreover, in the aforementioned known devices, light-transmissive plate or light-wave guiding path must be accurately positioned relative to a light emitter and a light receiver provided at the cartridge mounting portion. Further, the ink cartridge has other elements, which also must be positioned accurately relative to elements provided at the cartridge mounting portion. For example, an opening formed in the ink cartridge for supplying ink to the outside must be positioned accurately relative to an ink introduction tube provided at the cartridge mounting portion. These additional elements may complicate structures of the ink cartridge and the cartridge mounting portion.

Therefore, a need has arisen for an ink cartridge and an ink supply device, which overcome these and other shortcomings of the related art. A technical advantage of the present invention is that an ink amount stored in the ink cartridge may be determined when the ink amount is about zero and that the positioning of the ink cartridge relative to a cartridge mounting portion may readily be performed.

According to an embodiment of the present invention, an ink cartridge comprising a case comprising an ink chamber formed in the case, wherein the ink chamber is configured to store ink therein; an ink supply opening formed in the case, wherein the ink supply opening is opened to an exterior of the case and is configured to allow ink stored in the ink chamber to pass therethrough; and a light transmissive member disposed in the case and facing the ink supply opening, wherein the light transmissive member is configured to allow light entering via the ink supply opening to pass through the light transmissive member. The light transmissive member comprises a particular reflective surface, which has a first reflectance for the light entering via the ink supply opening and passing through the light transmissive member when the particular reflective surface contacts the ink stored in the ink chamber, and which has a second reflectance for the light entering via the ink supply opening and passing through the light transmissive member when the particular reflective surface does not contact the ink stored in the ink chamber. The first reflectance is different from the second reflectance.

According to another embodiment of the present invention, an ink supply device comprising an ink cartridge; and a cartridge mounting portion, wherein the ink cartridge is configured to be inserted into the cartridge mounting portion in an insertion direction and mounted to the cartridge mounting portion. The ink cartridge comprises a case comprising an ink chamber formed in the case, wherein the ink chamber is configured to store ink therein; and an ink supply opening formed in a front face of the case in the insertion direction, wherein the ink supply opening is configured to allow ink stored in the ink chamber to pass therethrough. The cartridge mounting portion comprises an ink introduction tube comprising a wall configured to allow light to pass therethrough, wherein an end portion of the ink introduction tube is configured to be inserted through the ink supply opening during insertion of the ink cartridge into the cartridge mounting portion, and the end portion comprises a particular reflective surface; a light emitter configured to emit light towards the particular reflective surface through the wall of the ink introduction tube; and a light receiver configured to receive the light emitted by the light emitter and reflected by the particular reflective surface through the wall of the ink introduction tube. The particular reflective surface has a first reflectance for the light emitted by the light emitter and passing through the wall of the ink introduction tube when the particular reflective surface contacts the ink stored in the ink chamber, and has a second reflectance for the light emitted by the light emitter and passing through the wall of the ink introduction tube when the particular reflective surface does not contact the ink stored in the ink chamber. The first reflectance is different from the second reflectance.

According to still another embodiment of the present invention, an ink cartridge comprising a case comprising an ink chamber formed in the case, wherein the ink chamber is configured to store ink therein; an ink supply opening formed in the case, wherein the ink supply opening is opened to an exterior of the case and is configured to allow ink stored in the ink chamber to pass therethrough; and a light transmissive member positioned in the case and facing the ink supply opening in an axial direction of the ink supply opening, wherein the light transmissive member is configured to allow light to pass therethrough, and comprises a first inclined surface and a second inclined surface offset from the first inclined surface in a direction perpendicular to the axial direction of the ink supply opening. The second inclined surface forms an acute angle A with the axial direction of the ink supply opening, and the first inclined surface forms an acute angle B with the axial direction of the ink supply opening. The first and the second inclined surfaces are arranged, such that the following conditions are satisfied:

angle $A$+angle $B$=90 degrees;

angle $A$>$SIN^{-1}$ ((absolute refractive index of air)/(absolute refractive index of the light transmissive member)); and angle $B$>$SIN^{-1}$ ((absolute refractive index of air)/(absolute refractive index of the light transmissive member)).

According to yet another embodiment of the present invention, an ink cartridge comprising a case comprising an ink chamber formed in the case, wherein the ink chamber is configured to store ink therein; an ink supply opening formed in the case, wherein the ink supply opening is opened to an exterior of the case and is configured to allow ink stored in the ink chamber to pass therethrough; and a valve member disposed in the case and configured to selectively move toward and away from the ink supply opening in a moving direction between an open position and a closed position. When the valve is in the open position, the ink supply opening is exposed, and, when the valve is in the closed position, the ink supply opening is covered by the valve. The valve is configured to allow light to pass therethrough, and comprises a first inclined surface and a second inclined surface offset from the first inclined surface in a direction perpendicular to the moving direction, wherein the second inclined surface forms an acute angle A with the axial direction of the ink supply opening, and the first inclined surface forms an acute angle B with the axial direction of the ink supply opening. The first and the second inclined surfaces are arranged, such that the following conditions are satisfied:

angle $A$+angle $B$=90 degrees;

angle $A$>$SIN^{-1}$ ((absolute refractive index of air)/(absolute refractive index of the valve)); and angle $B$>$SIN^{-1}$ ((absolute refractive index of air)/(absolute refractive index of the valve)).

Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-26B, like numerals being used for like corresponding parts in the various drawings.

Figure 1:
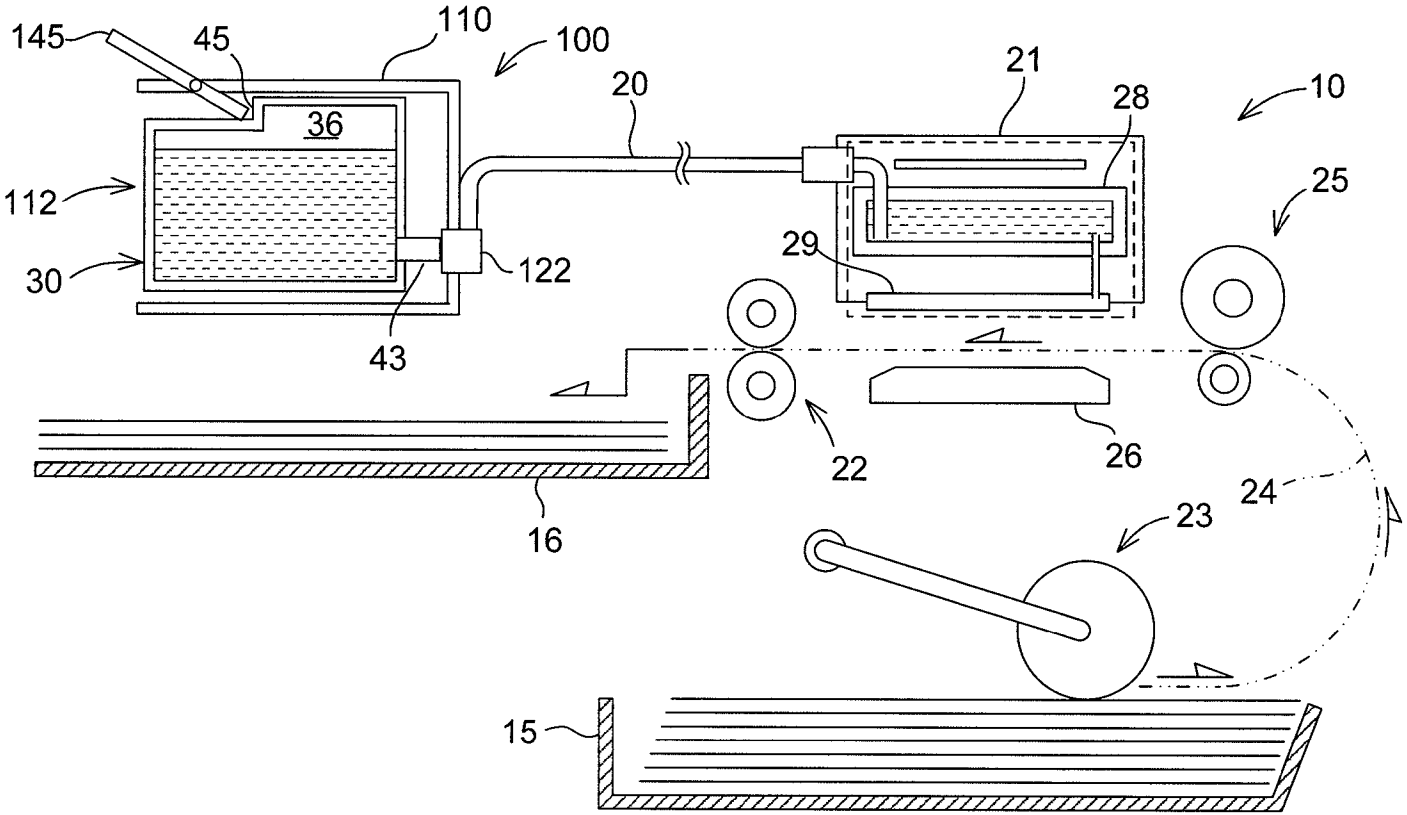
FIG. 1 is a schematic, cross-sectional view of a printer comprising an ink supply device according to an embodiment of the present invention.

FIGS. 1-16 depict a first embodiment and other embodiments of the present invention. Referring to FIG. 1, a printer 10 may be an inkjet printer configured to record an image on a sheet of paper by selectively ejecting ink droplets on the sheet of paper. Printer 10 may comprise an ink supply device 100. Ink supply device 100 may comprise a cartridge mounting portion 110. Cartridge mounting portion 110 may allow an ink cartridge 30 to be mounted therein. Cartridge mounting portion 110 may have an opening 112 and the inside of the cartridge mounting portion 110 may be exposed to the outside of cartridge mounting portion 110 via opening 112. Ink cartridge 30 may be inserted into cartridge mounting portion 110 via the opening 112, such that ink cartridge 30 may be mounted to cartridge mounting portion 110. Ink cartridge 30 may be removed from cartridge mounting portion 110 via the opening 112.

Ink cartridge 30 may be configured to store ink, which is used by printer 10. Printer 10 may comprise a recording head 21 and an ink tube 20. Ink cartridge 30 and recording head 21 may fluidically be connected via ink tube 20 when ink cartridge 30 is mounted in cartridge mounting portion 110. Recording head 21 may comprise a sub tank 28. Sub tank 28 temporarily may store ink supplied via ink tube 20 from ink cartridge 30. Recording head 21 may eject ink selectively supplied from sub tank 28 through nozzles 29.

A paper feed roller 23 may feed a sheet of paper from a paper feed tray 15 to a conveying path 24. A conveying roller pair 25 may convey the sheet of paper fed from paper feed tray 15 onto a platen 26. Recording head 21 may selectively eject ink onto the sheet of paper passing over platen 26. Accordingly, an image may be recorded on the sheet of paper. The sheet of paper having passed over platen 26 may be discharged to a paper discharge tray 16 disposed at the most downstream side of conveying path 24 by a discharge roller pair 22.

Figure 2:
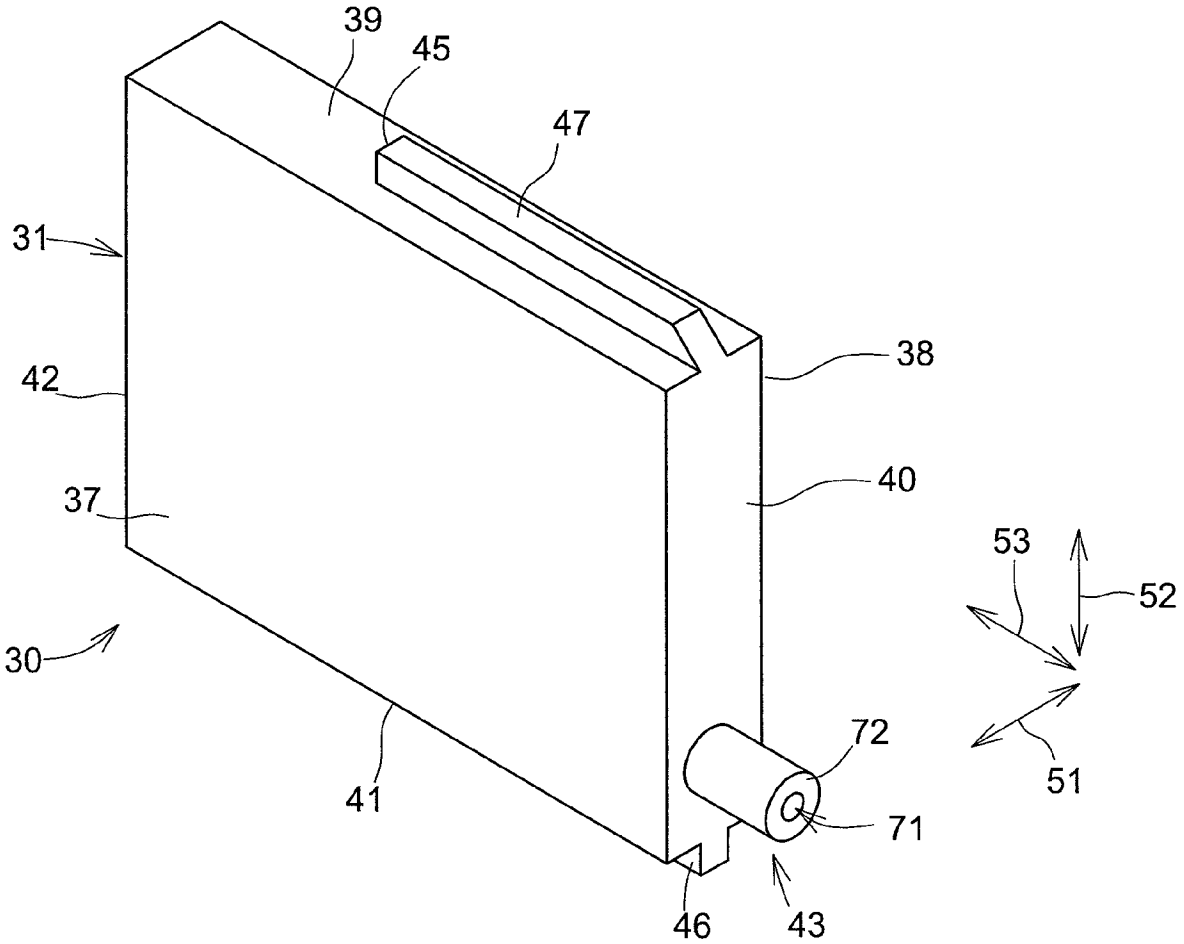
FIG. 2 is a perspective view of an ink cartridge according to an embodiment of the present invention.
Figure 3:
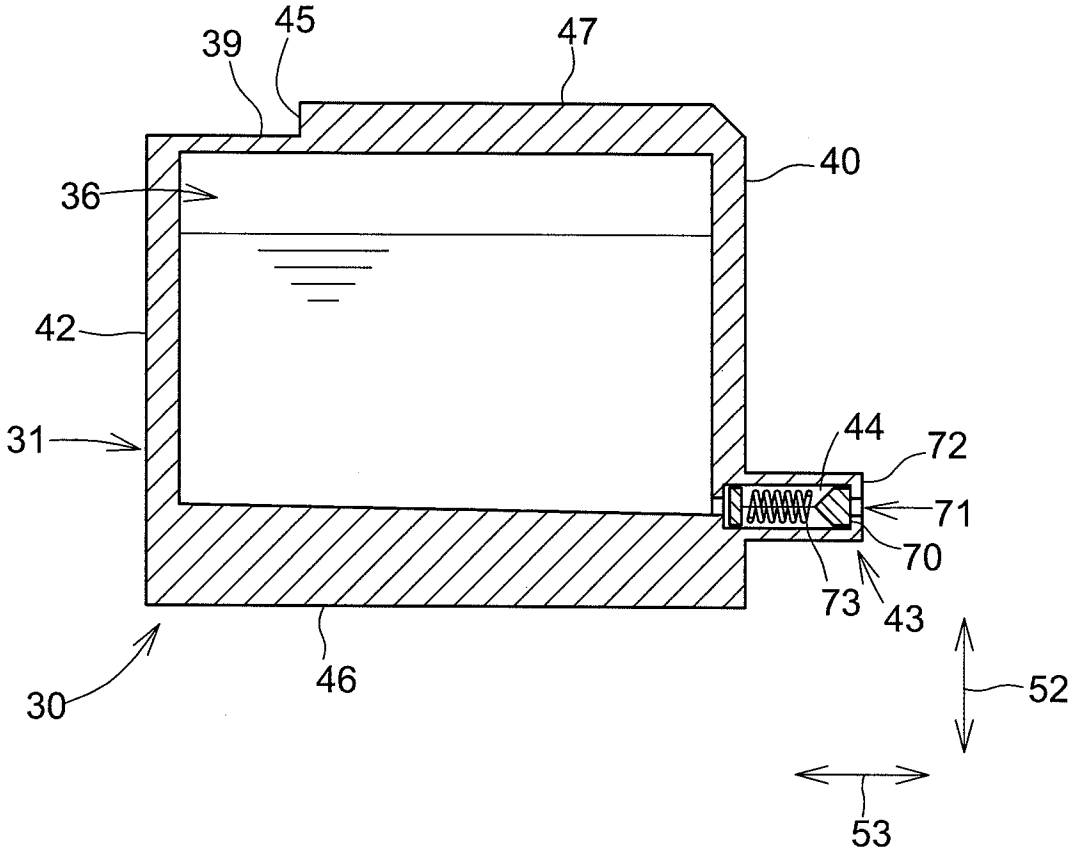
FIG. 3 is a vertical, cross-sectional view of the ink cartridge according to the embodiment of the present invention.
Figure 4:
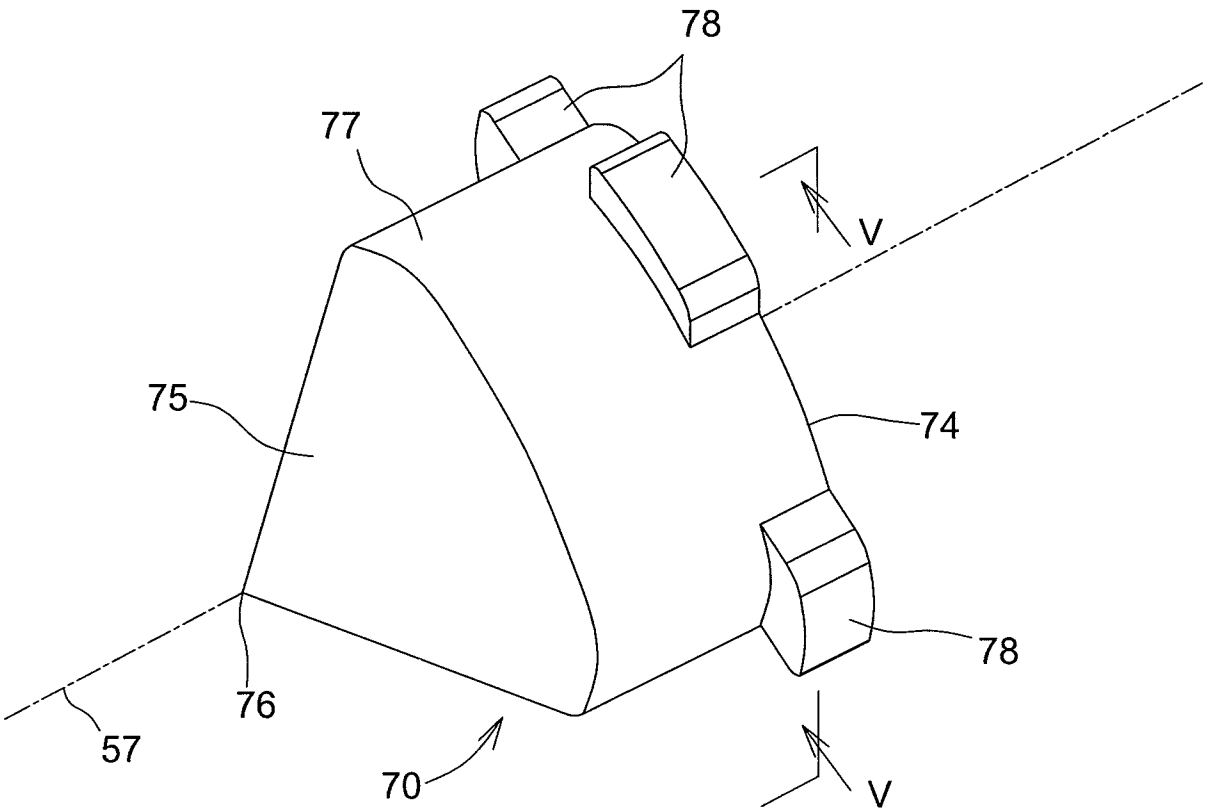
FIG. 4 is a perspective view of a light transmissive member of the ink cartridge according to an embodiment of the present invention.

Referring to FIGS. 2 to 4, ink cartridge 30 may be a container configured to store ink therein. Ink cartridge 30 may comprise an ink chamber 36, which may be a space formed in the interior of ink cartridge 30. Ink cartridge 30 also may comprise a case 31 forming an exterior of ink cartridge 30. Ink chamber 36 may have a space directly formed in the interior of case 31. In another embodiment, ink chamber 36 may have a space formed in the interior of a container which is disposed in case 31.

Figure 6:
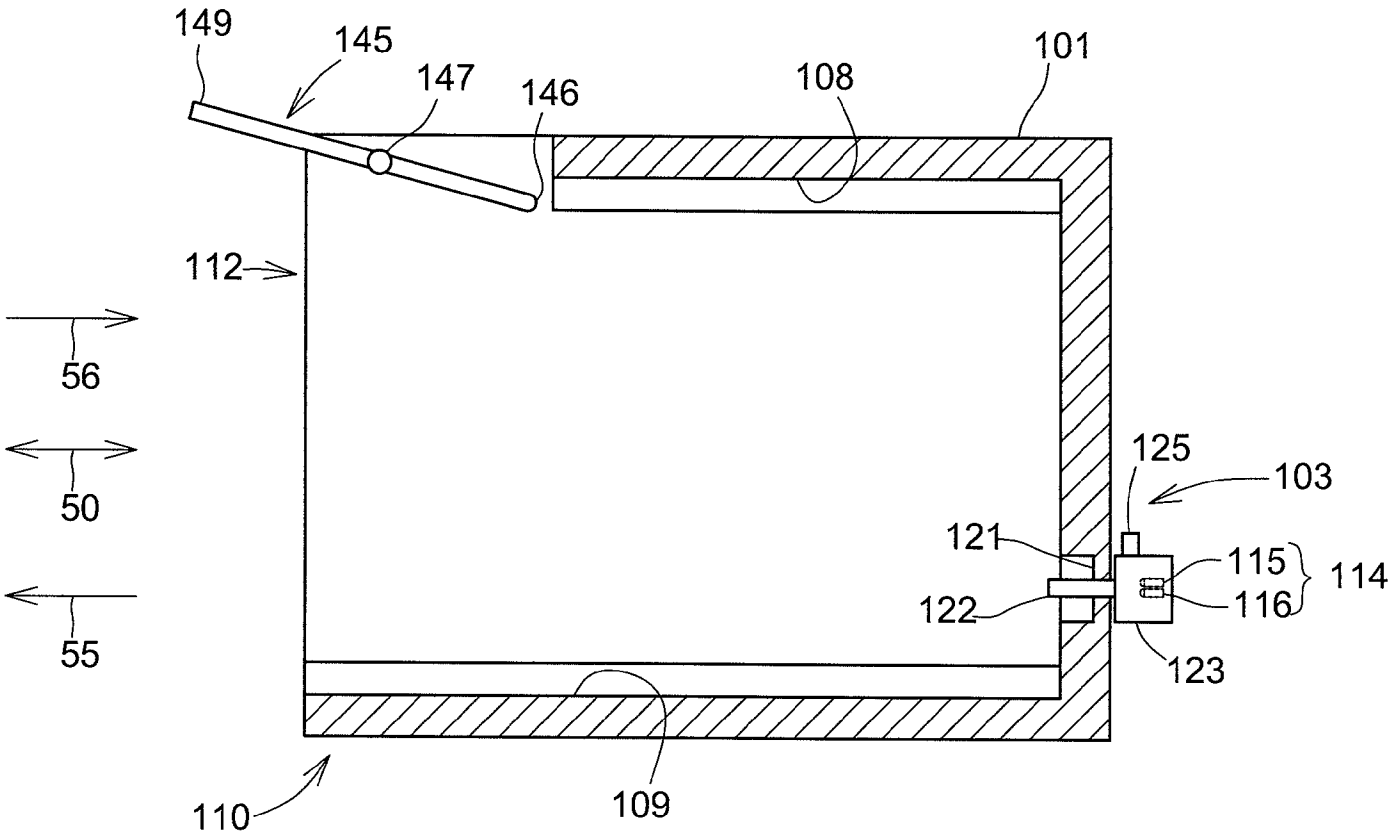
FIG. 6 is a vertical, cross-sectional view of a cartridge mounting portion according to an embodiment of the present invention.

Referring to FIGS. 2 and 6, ink cartridge 30 may be configured to be inserted into and removed from cartridge mounting portion 110 in an insertion/removal direction 50, while ink cartridge 30 is in an upright position, as shown in FIG. 2, with the top surface of ink cartridge 30 facing upward and the bottom surface of ink cartridge 30 facing downward. Ink cartridge 30 may be in the upright position when ink cartridge 30 is mounted to the cartridge mounting portion 110 in a mounted position. Referring to FIG. 6, ink cartridge 30 may be configured to be inserted into the cartridge mounting portion 110 in an insertion direction 56 and removed from the cartridge mounting portion 110 in a removal direction 55. Insertion/removal direction 50 may be a combination of insertion direction 56 and removal direction 55. Insertion direction 56, removal direction 55, and insertion/removal direction 50 may be horizontal directions.

Case 31 of ink cartridge 30 may have a substantially parallelepiped shape. Case 31 may have a width in a width direction 51, a height in a height direction 52, and a depth in a depth direction 53. Width direction 51, height direction 52, and depth direction 53 may be perpendicular to each other. A width of case 31 may be less than a height and a depth of case 31. When ink cartridge 30 is in the mounted position, width direction 51 may be parallel with a horizontal plane, depth direction 53 may also be parallel with the horizontal plane, and height direction 52 may be parallel with a vertical direction, i.e., a gravitational direction. When ink cartridge 30 is inserted into/removed from cartridge mounting portion 110, depth direction 53 may be parallel with insertion/removal direction 50, and width direction 51 and height direction 52 may be perpendicular to insertion/removal direction 50. Case 31 may comprise a front wall 40 and a rear wall 42. Front wall 40 may be disposed on a front side of case 31 with respect to insertion direction 56 in which ink cartridge 30 is inserted into cartridge mounting portion 110. Rear wall 42 may be disposed on a rear side of case 31 with respect to insertion direction 56 in which ink cartridge 30 is inserted into cartridge mounting portion 110. Font wall 40 and rear wall 42 may align in depth direction 53. Front wall 40 and rear wall 42 may align in insertion/removal direction 50 in which direction ink cartridge 30 is inserted into cartridge mounting portion 110. Case 31 may comprise side walls 37, 38, each extending in insertion/removal direction 50 and connected to front wall 40 and rear wall 42. Side walls 37 and 38 may align in width direction 51. Case 31 may comprise a top wall 39 connected to upper ends of front wall 40, rear wall 42, and side walls 37 and 38. Case 31 may comprise a bottom wall 41 connected to lower ends of front wall 40, rear wall 42, and side walls 37, 38. Top wall 39 and bottom wall 41 may align in height direction 52. The outer face of front wall 40 may be a front face, and the outer face of rear wall 42 may be a rear face. More specifically, the outer face of front wall 40 and elements provided at front wall 40, e.g., an ink supply portion 43, may be the front face, and the outer face of the rear wall 42 and elements provided at the rear wall 42, if any, may be the rear face.

Referring to FIGS. 2 and 3, case 31 may comprise ink supply portion 43 positioned at a lower portion of front wall 40 with respect to height direction 52. Ink supply portion 43 may have a circular, cylindrical outer shape, and may extend outward from front wall 40 in depth direction 53, e.g., insertion/removal direction 50. Ink supply portion 43 may have an end 72 disposed farthest from front wall 40, and an ink supply opening 71 may be formed in end 72. Ink supply opening 71 may be open to the exterior of case 31. Ink supply portion 43 may have an ink path 44 formed therein, and ink path 44 may extend in depth direction 53, e.g., insertion/removal direction 50, from ink supply opening 71 to ink chamber 36.

A light transmissive member 70 may open and close ink supply opening 71 selectively. Light transmissive member 70 may face ink supply opening 71 in depth direction 53, e.g., insertion/removal direction 50. Light transmissive member 70 also may face ink supply opening 71 in an axial direction of ink supply opening 71. Light transmissive member 70 may be a valve configured to move in ink path 44 selectively toward and away from ink supply opening 71 in depth direction 53, e.g., insertion/removal direction 50. Light transmissive member 70 may be biased by a biasing member, e.g., coil spring 73, towards ink supply opening 71. Therefore, when an external force is not applied to light transmissive member 70, light transmissive member 70 may be in a closed position, in which position ink supply opening 71 is liquid-tightly sealed by light transmissive member 70. End 72 of ink supply portion 43 may comprises a resilient member, e.g., rubber, surrounding ink supply opening 71. When the biased light transmissive member 70 contacts the resilient member, the resilient member may be deformed resiliently, such that ink supply opening 71 may be sealed liquid-tightly. In the closed position, a portion of light transmissive member 70 may be exposed via ink supply opening 71 to the exterior of ink supply portion 43, e.g., the exterior of the ink cartridge 30.

When ink cartridge 30 is mounted to cartridge mounting portion 110, an ink introduction tube 122 of cartridge mounting portion 110 may be inserted through ink supply opening 71. Ink introduction tube 122 may contact and move light transmissive member 70 against the biasing force of coil spring 73 while the coil spring 73 contracts, such that light transmissive member 70 may move to an open position, in which light transmissive member 70 is disposed away from ink supply opening 71 and ink supply opening 71 is opened. When ink supply opening 71 is opened, ink may be supplied from ink chamber 36 into ink introduction tube 122 via ink path 44 and ink supply opening 71. Case 31 may comprise an air introduction portion (not shown). While ink is supplied from ink chamber 36 into ink introduction tube 122, air may be introduced from the exterior of ink cartridge 30 into ink chamber 36 via the air introduction portion.

Figure 5:
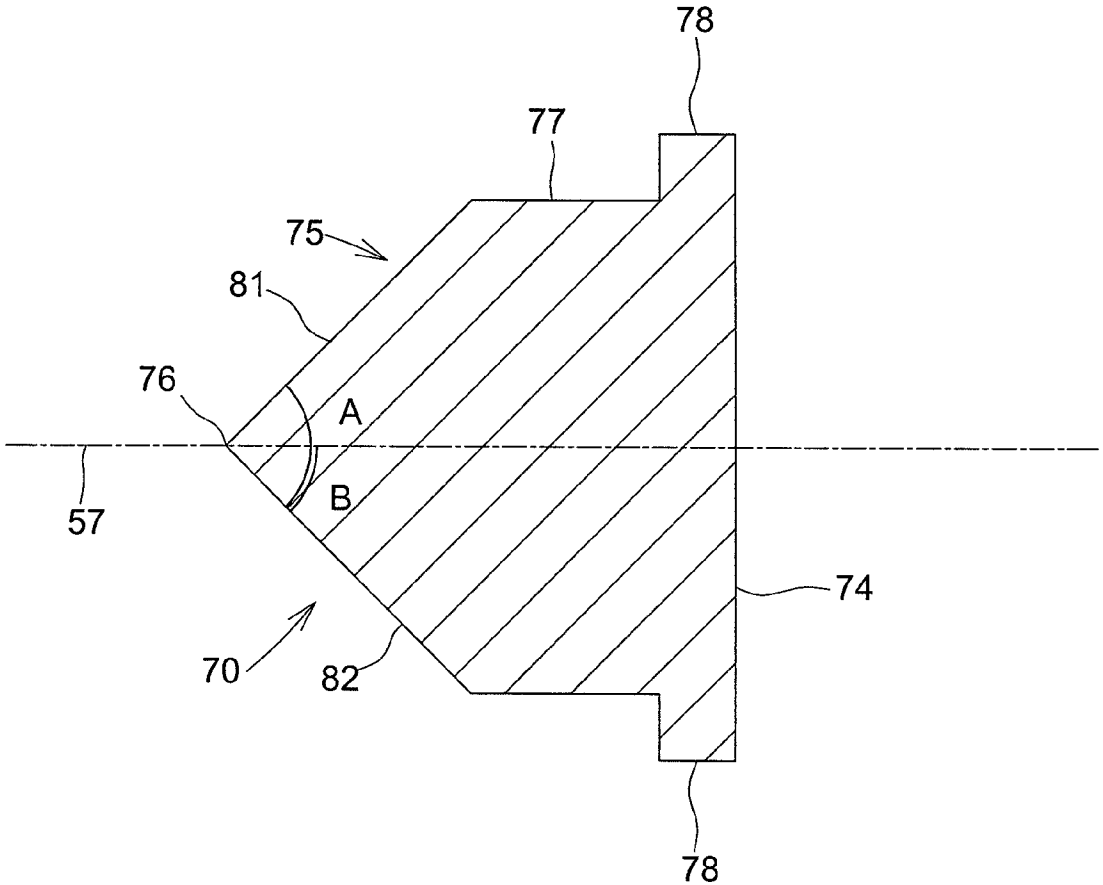
FIG. 5 is a cross-sectional view of the light transmissive member taken along the line V-V of FIG. 4.

Referring to FIGS. 4 and 5, light transmissive member 70 may comprise a circular cone portion 75 on its ink chamber 36 side and a circular cylindrical portion on its ink supply opening 71 side. A planar surface 74 of the cylindrical portion of light transmissive member 70 may be configured to face ink supply opening 71. When light transmissive member 70 is in the closed position, a center portion of the planar surface 74 may be exposed to the exterior of ink cartridge 30 via the ink supply opening 71. A vertex 76 of circular cone portion 75 may be positioned at a center line 57 of light transmissive member 70, which passes through the center of planar surface 74 and is perpendicular to planar surface 74. Center line 57 may extend parallel to depth direction 53, e.g., insertion/removal direction 50, and may pass through the center of ink supply opening 71. Center line 57 may align with the axial direction of ink supply opening 71. Light transmissive member 70 may be configured to move in ink path 44 of ink supply portion 43 along center line 57. Therefore, center line 57 also may align with the moving direction of light transmissive member 70.

Light transmissive member 70 may comprise four spring seats 78 extending radially in four directions from a side wall 77 of the cylindrical portion adjacent to planar surface 74. An end of coil spring 73 may contact spring seats 78, such that the biasing force of coil spring 73 may be transferred to light transmissive member 70. The spring seats 78 may contact the inner wall surface of ink supply portion 43. Light transmissive member 70 may be configured to move in ink path 44 while spring seats 78 may slide on the inner wall surface of ink supply portion 43, such that center line 57 is aligned with depth direction 53, e.g., insertion/removal direction 50 and the axial direction of ink supply opening 71.

Light transmissive member 70 may comprise a material which allows light to pass therethrough, e.g., polypropylene resin, acrylic resin, polycarbonate resin, glass, and etc. FIG. 5 depicts a cross sectional view of light transmissive member 70 taken along center line 57 parallel to height direction 52 and depth direction 53. In this cross sectional view, circular cone portion 75 comprises a first inclined surface 82, e.g., reflective surface, and a second inclined surface 81, e.g., reflective surface, with the center line 57 positioned therebetween. Second inclined surface 81 may be offset from first inclined surface 82 in a direction perpendicular to center line 57. Second inclined surface 81 also may be offset from first inclined surface 82 in a direction perpendicular to depth direction 53, e.g., insertion/removal direction 50, insertion direction 56, the moving direction of light transmissive member 70, and the axial direction of ink supply opening 71. First inclined surface 82 and the second inclined surface 81 may be arranged in height direction 52, e.g., vertical direction. Each of first inclined surface 82 and second inclined surface 81 may incline toward center line 57. Each of first inclined surface 82 and second inclined surface 81 may incline with respect to depth direction 53, e.g., insertion/removal direction 50, insertion direction 56, the moving direction of light transmissive member 70, or the axial direction of ink supply opening 71. A cross section of each of first inclined surface 82 and second inclined surface 81 may be a straight line, as shown in FIG. 5.

First inclined surface 82 may form an acute angle B with center line 57, e.g., the moving direction of light transmissive member 70, or the axial direction of ink supply opening 71. Second inclined surface 81 may form an acute angle A with center line 57, e.g., the moving direction of light transmissive member 70 or the axial direction of ink supply opening 71. Angles A and B may satisfy the following conditions:

angle $A$+angle $B$=90 degrees; Condition 1:

angle $A$>SIN$^{-1}$ ((absolute refractive index of air)/(absolute refractive index of the light transmissive member 70)); and Condition 2:

angle $B$>SIN$^{-1}$ ((absolute refractive index of air)/(absolute refractive index of the light transmissive member 70)). Condition 3:

Each of first inclined surface 82 and second inclined surface 81 may have a first reflectance R1 for light passing through the light transmissive member 70 when contacting ink stored in ink chamber 36 and a second reflectance R2 for light passing through the light transmissive member 70 when not contacting ink stored in ink chamber 36. First reflectance R1 may be different from second reflectance R2. For example, when first inclined surface 82 or second inclined surface 81 has first reflectance R1, light passing through light transmissive member 70 in insertion/removal direction 50 may mostly pass through first inclined surface 82 or second inclined surface 81 and reaches the ink in ink chamber 36. When first inclined surface 82 or second inclined surface 81 has second reflectance R2, light passing through light transmissive member 70 in insertion/removal direction 50 may be totally reflected on first inclined surface 82 or second inclined surface 81. Reflectances R1 and R2 may be realized by angles A and B that satisfy the above conditions 2 and 3. Because angles A and B satisfy the above condition 1, when light travelling in insertion/removal direction 50 is reflected totally on first inclined surface 82 and second inclined surface 81, the reflected light may travel in insertion/removal direction 50. Thus, first inclined surface 82 and second inclined surface 81 may cause light to travel in removal direction 55 to be reflected in insertion direction 56.

Referring to FIGS. 2 and 3, case 31 may comprise a contact portion 45 at a middle portion of top wall 39 with respect to depth direction 53. Contact portion 45 may comprise a planar surface extending in width direction 51 and height direction 52. Contact portion 45 may be configured to contact a lock lever 145 when ink cartridge 30 is mounted to cartridge mounting portion 110.

Case 31 may comprise a guide portion 47 at top wall 39. Guide portion 47 may extend upward from top wall 39 and may extend in depth direction 53. A distance between the outer faces of side walls of guide portion 47 in the width direction 51 may be less than a distance between the outer faces of side walls 37 and 38 of case 31 in width direction 51. Thus, the width of guide portion 47 in width direction 51 may be less than the width of case 31 in width direction 51. Contact portion 45 may be disposed at the end of guide portion 47 at a rear wall 42 side.

Case 31 may comprise a guide portion 46 at bottom wall 41. Guide portion 46 may extend downward from bottom wall 41 and may extend in depth direction 53. A distance between the outer faces of side walls of guide portion 46 in width direction 51 may be less than a distance between the outer faces of side walls 37 and 38 of case 31 in width direction 51. Thus, the width of guide portion 46 in width direction 51 may be less than the width of case 31 in width direction 51. Guide portions 46 and 47 may be configured to be inserted into guide grooves 109 and 108 respectively when ink cartridge 30 is inserted into cartridge mounting portion 110.

Referring to FIG. 6, cartridge mounting portion 110 may comprise a case 101 having an opening 112 formed therein. Case 101 may have an inner space formed therein, and may comprise an upper surface defining the upper end of the inner space and a lower surface defining the lower end of the inner space. Ink cartridge 30 may be configured to be inserted into and removed from case 101 via opening 112. Ink cartridge 30 may be configured to be guided in insertion/removal direction 50 with guide portion 47 inserted into groove 108 formed in the upper surface of case 101 and guide portion 46 inserted into groove 109 formed in the lower surface of case 101. Case 101 may be configured to receive four ink cartridges 30 storing cyan ink, magenta ink, yellow ink, and black ink, respectively. FIG. 6 depicts a portion of case 101 corresponding to one of the four ink cartridges 30.

Case 101 may comprise an end surface disposed opposite from opening 112 in insertion/removal direction 50 and facing the inner space of case 101. Cartridge mounting portion 110 may comprise a connecting portion 103 disposed at a lower portion of the end surface of case 101. Four connecting portions 103 may be provided corresponding to the four ink cartridges 30. FIG. 6 depicts one of the four connection portions 103. Connecting portion 103 may be disposed at a position corresponding to ink supply portion 43 of ink cartridge 30 when ink cartridge is mounted to case 101.

Connecting portion 103 may comprise ink introduction tube 122 and a holding portion 121. Ink introduction tube 122 may be a cylindrical tube comprising a resin which allows light to pass therethrough. Ink introduction tube 122 may be connected to ink tube 20 via a connector 123 and a connecting tube 125 at the exterior of case 101. Ink tube 20 may connect to ink introduction tube 122 and may extend to recording head 21 of printer 10.

Figure 11:
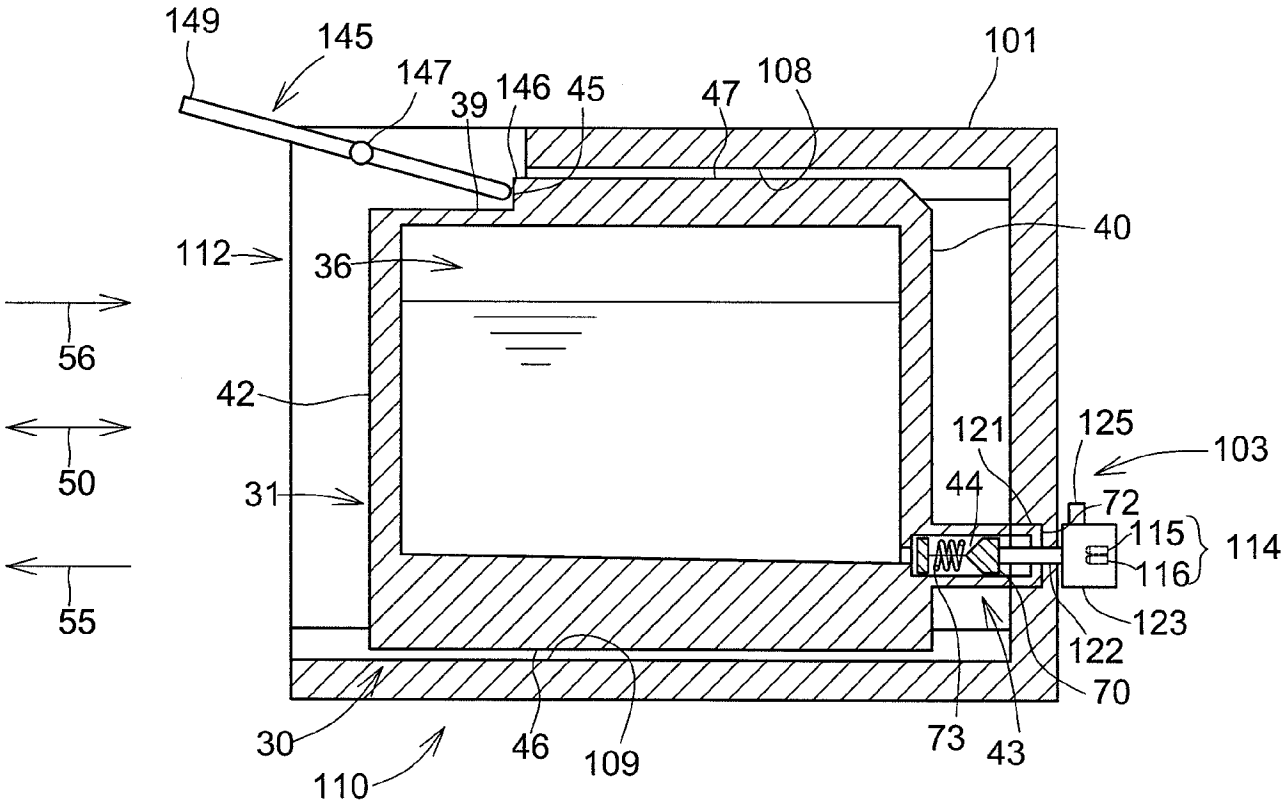
FIG. 11 is a vertical, cross-sectional view of the ink cartridge and the cartridge mounting portion when the ink cartridge is in a mounted position in the cartridge mounting portion according to the embodiment of the present invention.

Holding portion 121 may be a cylindrical recess portion formed at the end surface of case 101 in insertion direction 56. Ink introduction tube 122 may extend in insertion/removal direction 50 at the center of holding portion 121. Referring to FIG. 11, when ink cartridge 30 is mounted to cartridge mounting portion 110, cylindrical ink supply portion 43 may be inserted into cylindrical holding portion 121, such that the outer peripheral surface of ink supply portion 43 may contact the surface of holding portion 121. When ink supply portion 43 is inserted into holding portion 121, ink introduction tube 122 may be inserted into ink supply opening 71 of ink supply portion 43, and ink introduction tube 122 may urge and move light transmissive member 70 from the closed position to the open position against the biasing force of coil spring 73. Thus, ink stored in ink chamber 36 may be supplied to the exterior of ink cartridge 30. Ink may flow out of ink chamber 36 into ink introduction tube 122, and may be supplied to recording head 20 via ink tube 20.

Figure 7:
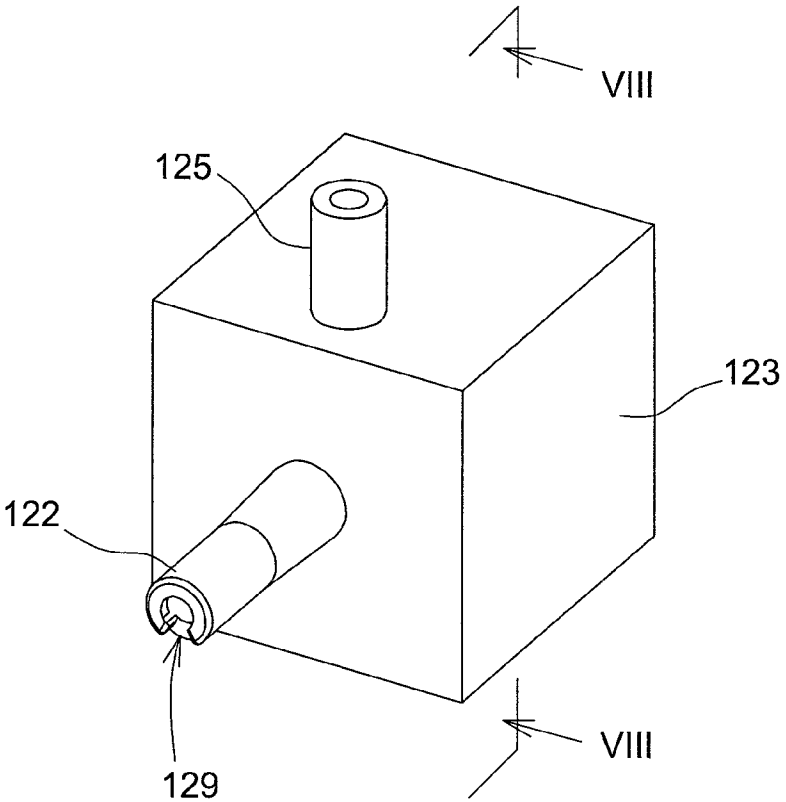
FIG. 7 is a perspective view of an ink introduction tube according to an embodiment of the present invention.
Figure 8:
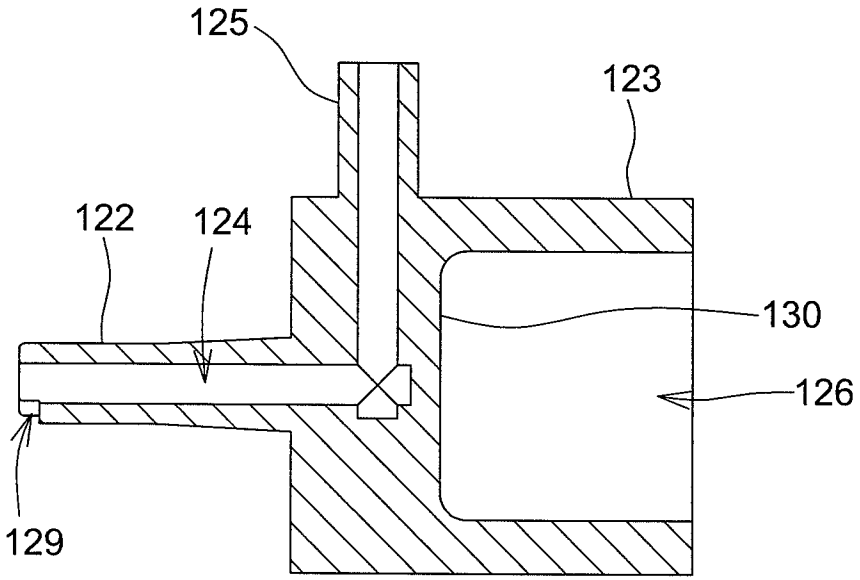
FIG. 8 is a cross-sectional view of the ink introduction tube taken along the line VIII-VIII of FIG. 7.

Referring to FIGS. 7 and 8, ink introduction tube 122 may extend from connector 123, which may have a cubic shape. Referring to FIG. 6, ink introduction tube 122 may extend through the center of holding portion 121 toward opening 112 in insertion/removal direction 50. Ink introduction tube 112 may be a cylindrical tube, and the outer diameter thereof may be set such that ink introduction tube 112 may be inserted into ink supply opening 71 of ink cartridge 30. The dimension of ink introduction tube 112 in its axial direction, e.g., insertion/removal direction 50, may be sufficient to contact and move light transmissive member 70 from the closed position to the open position. Consequently, during the insertion of ink cartridge 30 into cartridge mounting portion 110, ink introduction tube 112 may be inserted into ink supply opening 71 and may move light transmissive member 70 from the close position to the open position against the biasing force of coil spring 73. Because end 72 of ink supply portion 43 comprises the resilient member, e.g., rubber, surrounding ink supply opening 71, when ink introduction tube 122 is inserted into ink supply opening 71, the resilient member may be deformed resiliently and may contact tightly the outer surface of ink introduction tube 122.

Referring to FIGS. 7 and 8, ink introduction tube 122 may have an ink path 124 formed therein. Ink path 124 may bend upward in connector 123 and may connect to an inner space of connecting tube 125, which extends from the upper surface of connector 123. Connecting tube 125 may be a cylindrical tube connected to ink tube 20.

An ink introduction opening 129 may be formed at an end of ink introduction tube 122 farthest from connector 123. The exterior of ink introduction tube 122 may be in fluid communication with the ink path 124 via ink introduction opening 129. Ink introduction opening 129 may be formed at a lower side of the end of ink introduction tube 122. Ink introduction opening 129 may be a recess or a cut out formed in the wall of ink introduction tube 122 from the end of ink introduction tube 122 towards connector 123 in insertion/removal direction 50. When the end of ink introduction tube 122 contacts light transmissive member 70, ink may be supplied into the inner space of ink introduction tube 122, e.g., into ink path 124, via ink introduction opening 129.

Connector 123 may have a recess 126 formed therein. Recess 126 may be a recess formed in a side wall of connector 123 toward ink introduction tube 122 in insertion/removal direction 50, which side wall is opposite a side wall from which the ink introduction tube 122 extends. Recess 126 may not be in fluid communication with ink path 124. An end surface 130 defining the end of recess 126 on an ink path 124 side may be positioned adjacent to ink path 124.

Ink introduction tube 122 and connector 123 may comprise a resin material, e.g., polypropylene resin, acrylic resin, or polycarbonate resin, or glass, which allows light emitted by a light emitter 115 to pass therethrough. Therefore, light emitted towards end surface 130 of recess 126 may pass through connector 123 and the wall of ink introduction tube 122 and may reach the end of ink introduction tube 122. Similarly, light emitted towards the end of ink introduction tube 122 may pass through the wall of ink introduction tube 122 and connector 123 and may reach the end surface 130.

Figure 12:
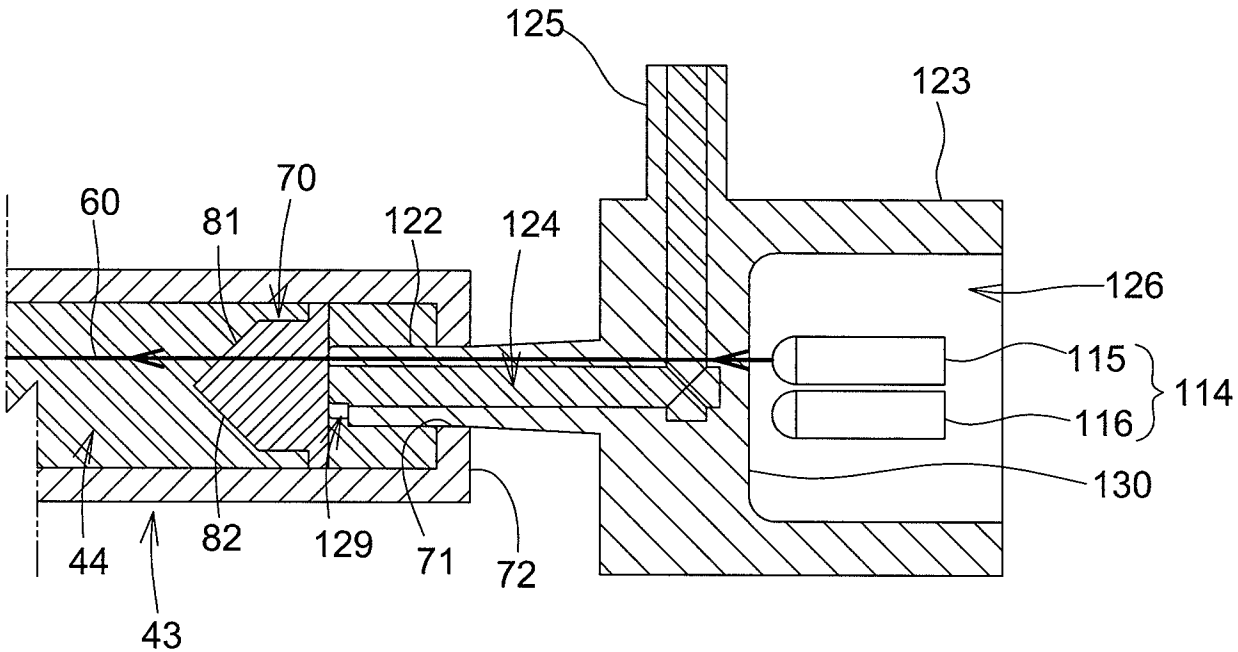
FIG. 12 is a vertical cross-sectional view of an ink supply portion of the ink cartridge and the ink introduction tube, depicting a light path when an ink path of the ink cartridge is filled with ink according to an embodiment of the present invention.
Figure 13:
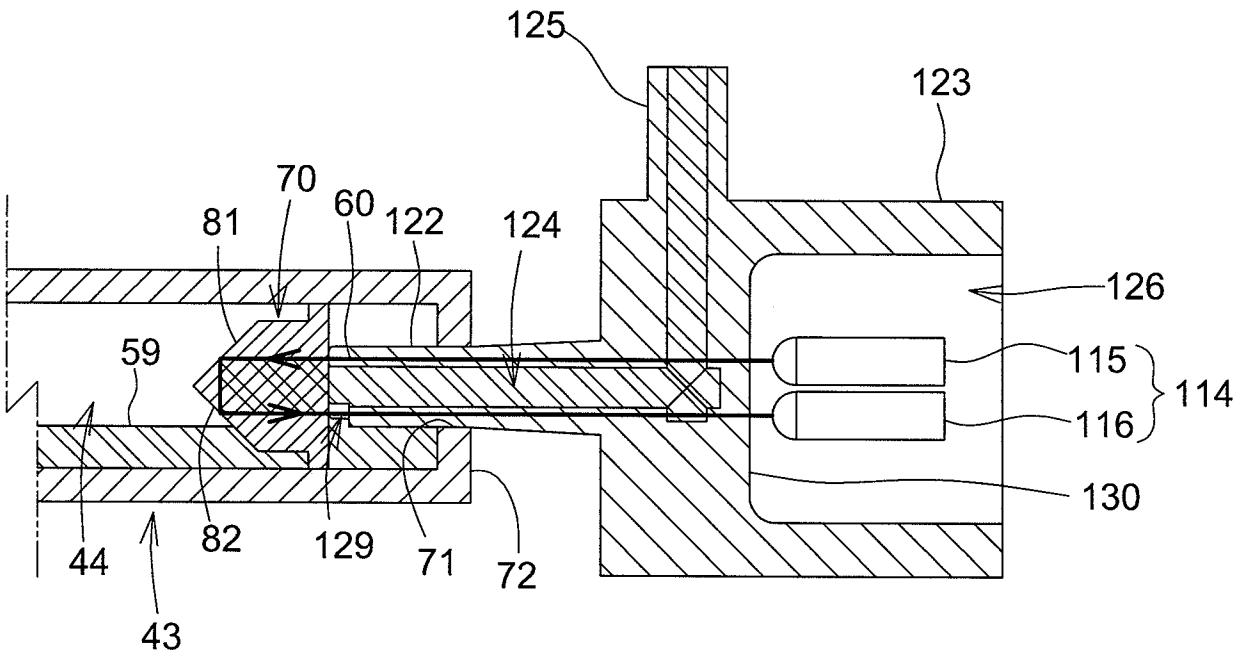
FIG. 13 is a vertical, cross-sectional view of the ink supply portion and the ink introduction tube, depicting a light path when the ink surface in the ink path has lowered according to the embodiment of the present invention.

Referring to FIGS. 6, 12, and 13, an optical sensor 114 may be disposed in recess 126 of connector 123. Optical sensor 114 may comprise light emitter 115, e.g., a light emitting diode, and a light receiver 116, e.g., a photo-transistor. Light emitter 115 and light receiver 116 may be arranged in the vertical direction with light emitter 115 positioned above light receiver 116. Light emitter 115 may be configured to emit light, e.g., visible or infrared light, via end surface 130 of recess 126 towards an upper portion of the end of ink introduction tube 122 in insertion/removal direction 50. Light receiver 116 may be configured to receive light passing through a lower portion of the wall of ink introduction tube 122 and reaching end surface 130.

Referring to FIG. 6, cartridge mounting portion 110 may comprise lock lever 145 positioned at an upper portion of opening 112 of case 101. Lock lever 145 may be configured to retain ink cartridge 30 mounted in cartridge mounting portion 110 in the mounted position.

Figure 10:
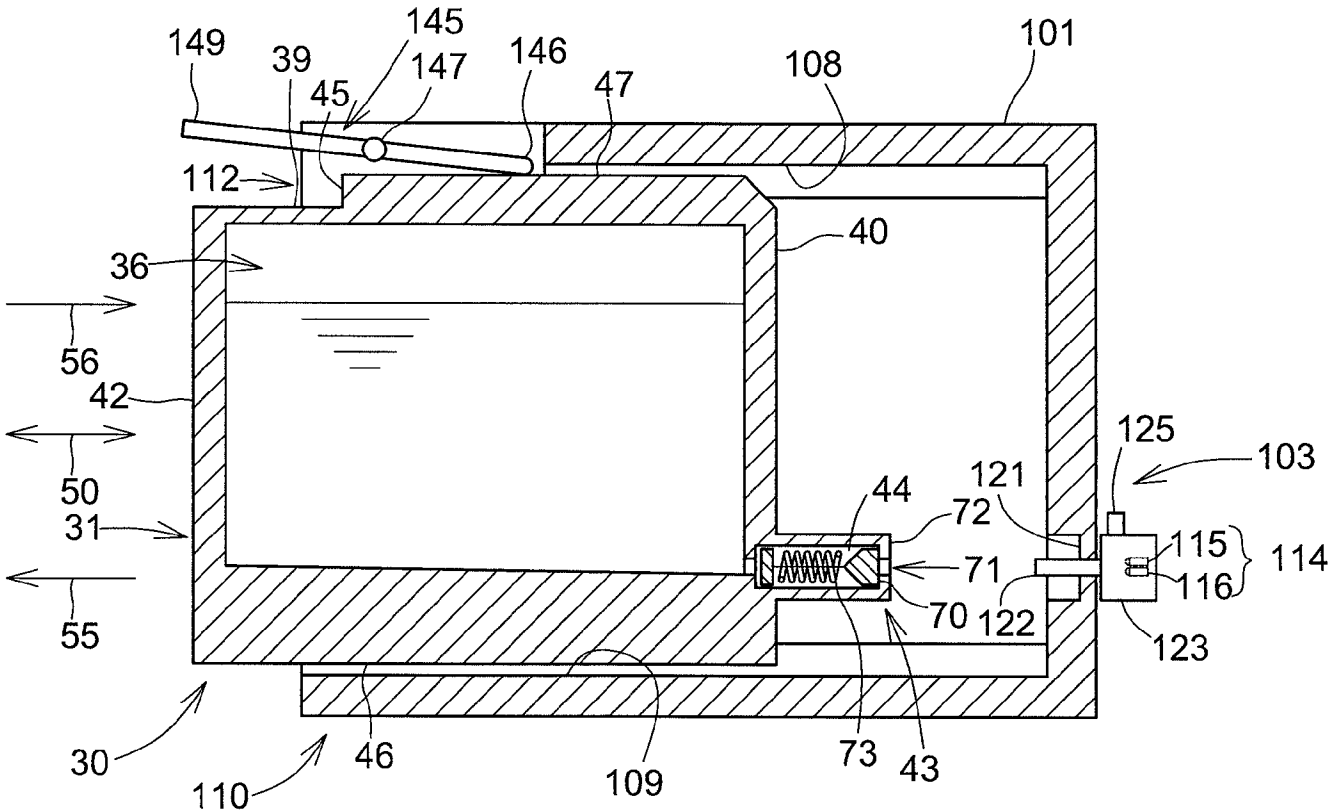
FIG. 10 is a vertical, cross-sectional view of the ink cartridge and the cartridge mounting portion during insertion of the ink cartridge into the cartridge mounting portion according to an embodiment of the present invention.

Lock lever 145 may comprise a support shaft 147 at its middle portion. Support shaft 147 may be supported by case 101. Lock lever 145 may be configured to pivot about support shaft 147 at the upper portion of opening 112. Lock lever 145 may comprise an operation portion 149 and contact portion 146. Operation portion 149 may extend to the exterior of case 101 via opening 112. Operation portion 149 may be configured to receive a force to pivot lock lever 145. Contact portion 146 may extend into the inner space of case 101. Contact portion 146 may be configured to contact contact portion 45 of ink cartridge 30. When contact portion 146 contacts contact portion 45, ink cartridge 30 may be retained in the mounted position. Lock lever 145 may be configured to pivot between a lock position in which contact portion 146 contacts contact portion 45, as depicted in FIG. 11, and an unlock position in which contact portion 146 separates from contact portion 45, as depicted in FIG. 10.

A coil spring may be connected to lock lever 145, and lock lever 145 may be biased towards the lock position by the coil spring. When operation portion 149 is pushed down, lock lever 145 may pivot from the lock position to the unlock position.

Figure 9:
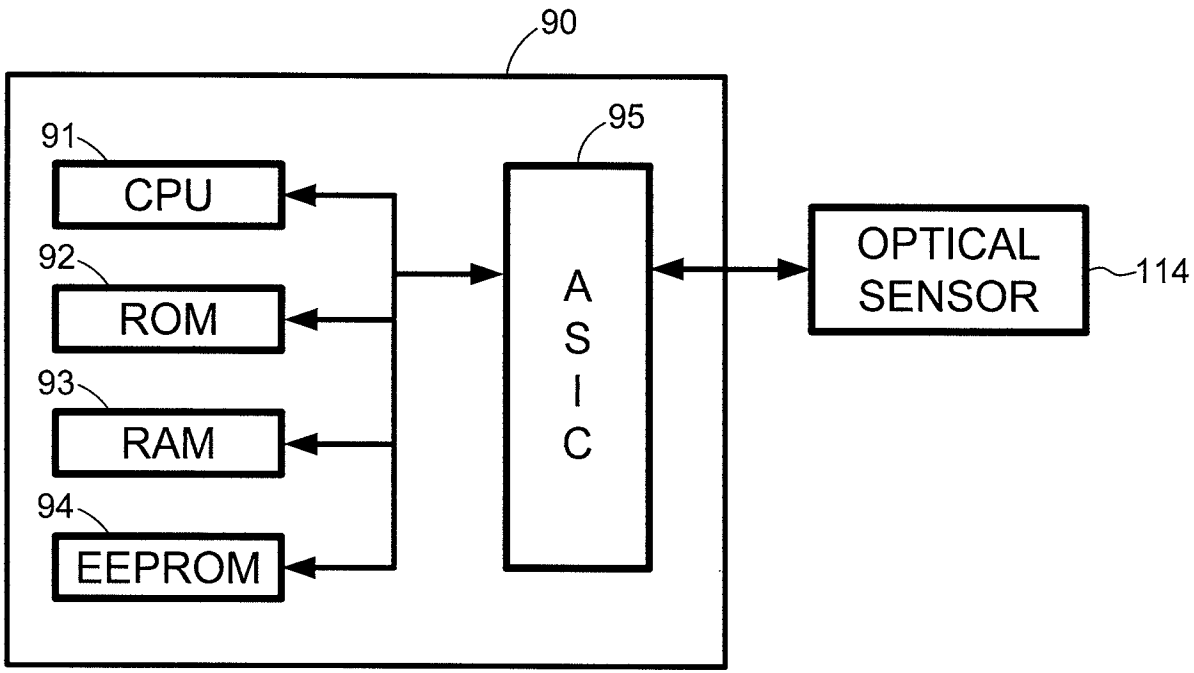
FIG. 9 is a block diagram of a controller of the printer according to an embodiment of the present invention.

Referring to FIG. 9, printer 10 may comprise a controller 90 configured to control the operation of printer 10. Controller 90 may comprise a CPU 91, a ROM 92, a RAM 93, an EEPROM 94, and an ASIC 95.

ROM 92 may store programs for CPU 91 to control various operations of printer 10 and to execute a determination process. RAM 93 may be used as a storage area for temporarily store date and signals for CPU91 to use in executing the programs and as a working area for date processing. EEPROM 94 may store settings and flags which may be retained even after the power is off.

ASIC 95 may be connected to optical sensor 114. ASIC 95 also may be connected to a driving circuit for driving paper feed roller 25, conveying roller pair 25, etc. ASIC 95 also may be connected to an input portion through which instructions for recoding image may be input to printer 10, and may be connected to a display which may display information about printer 10.

Optical sensor 114 may be configured to output an electric signal, e.g., current signal or voltage signal. The intensity of the signal may depend on the intensity of light received by light receiver 116. Controller 90 may be configured to monitor the electric signal from optical sensor 114 at a certain interval. Controller 90 may determine that the signal is a HI level signal when the value of the electric signal, e.g., voltage value or current value, is greater than or equal to a threshold value and that the signal is a LOW level signal when the value of the electric signal is less than the threshold value.

Referring to FIG. 10, when ink cartridge 30 is inserted into cartridge mounting portion 110 in insertion direction 56, an inclined end surface of guide portion 47 facing insertion direction 56 may contact contact portion 146 of lock lever 145. The inclined end surface may incline forward and downward. When ink cartridge 30 is further inserted, contact portion 146 of lock lever 145 may climb onto the upper surface of guide portion 47, such that lock lever 145 may pivot counterclockwise from the lock position to the unclock position, as shown in FIG. 10.

Referring to FIG. 11, when ink cartridge 30 reaches the mounted position, contact portion 45 may pass over contact portion 146 of lock lever 145. Because contact portion 146 of lock lever 145 is no longer supported by guide portion 47, lock lever 145 may pivot clockwise and contact portion 146 may contact contact portion 45, as shown in FIG. 11. With contact portion 146 contacting contact portion 45, ink cartridge 30 may be retained in the mounted position and the mounting of ink cartridge 30 to cartridge mounting portion 110 may be completed.

During the insertion of ink cartridge 30 into cartridge mounting portion 110, ink supply portion 43 may be inserted into holding portion 121, and ink introduction tube 122 may be inserted into ink supply opening 71 of ink supply portion 43 to move light transmissive member 70. By the insertion of ink supply portion 43 into holding portion 121 and the insertion of ink introduction tube 122 into ink supply opening 71, ink cartridge 30 may be positioned at a certain position relative to cartridge mounting position 110. When ink cartridge 30 is mounted to cartridge mounting portion 110, the end of ink introduction tube 122 may contact planar surface 74 of light transmissive member 70, such that light transmissive member 70 may move to the open position away from ink supply opening 71 against the biasing force of coil spring 73. Because ink introduction opening 129 is formed at the end of ink introduction tube 122, ink may be supplied from ink chamber 33 via ink path 44 and ink introduction opening 129 and into ink path 124 of ink introduction tube 122.

When ink cartridge 30 is mounted to cartridge mounting portion 110, controller 90 may cause optical sensor 114 to emit light from light emitter 115 and may monitor the electric signal depending on the intensity of light received by light receiver 116 at certain timings. The timings may include a timing when the mounting of ink cartridge 30 to cartridge mounting portion 110 is completed, when printer 10 completes printing one page, or when printer 10 is powered on.

Referring to FIG. 12, light 60 emitted by light emitter 115 of optical sensor 114 may pass through the wall of ink introduction tube 122 in insertion/removal direction 50 and may reach the light transmissive member 70 via ink supply opening 71. Light 60 may enter light transmissive member 70 from planar surface 74, may pass through light transmissive member 70, and may reach second inclined surface 81 of circular cone portion 75. Ink path 44 formed in ink supply portion 43 may be filled with ink stored in ink chamber 36, such that second inclined surface 81 may contact the ink. Coil spring 73 is not depicted in FIG. 12.

Because second inclined surface 81 contacts ink, second inclined surface 81 may allow light 60 emitted by light emitter 115 to pass through light transmissive member 70 and to reach the ink. Thus, little or no light 60 passing through light transmissive member 70 may pass through the wall of ink introduction tube 122 to reach light receiver 116. Controller 90 may receive the electric signal output from optical sensor 114, the intensity of which may depend on the intensity of light 60 received by light receiver 116. Controller 90 may determine whether the value of the electric signal is greater than or equal to the threshold value. In this case, because the intensity of light 60 received by light receiver 116 is very weak or about zero, the value of the electric signal may be less than the threshold value. Therefore, controller 90 may determine that the signal is the LOW level signal. When controller 90 determines that the signal output from light receiver 116 is the LOW level signal, controller 90 may determine that there is sufficient ink left in ink chamber 36 of ink cartridge 30 or that it is not necessary to replace ink cartridge 30.

As printer 10 performs printing, ink stored in ink chamber 36 of ink cartridge 30 may be consumed. When the amount of ink stored in ink chamber 36 becomes small, an ink surface 59 in ink path 44 may be lowered. When ink surface 59 is positioned below ink introduction opening 129 of ink introduction tube 122, e.g., below the lower portion of ink introduction tube 122, ink may not flow into ink path 124 of ink introduction tube 122, such that air flows into ink path 124 of ink introduction tube 122.

Referring to FIG. 13, when ink surface 59 in ink path 44 is lowered to a level adjacent to the most bottom end of the lower portion of ink supply tube 122, second inclined surface 81 may not contact ink, such that second inclined surface 81 may totally reflect light 60 emitted by light emitter 115 and passed through light transmissive member 70. Light 60 may be reflected totally on second inclined surface 81 and may pass through light transmissive member 70 toward first inclined surface 82. Because first inclined surface 82 does not contact ink, first inclined surface 82 may reflect totally light 60 which has been totally reflected on second inclined surface 81. Light 60 reflected totally on first inclined surface 82 may pass through light transmissive member 70 and the wall of light introduction tube 122 towards light receiver 116 in insertion/removal direction 50, and may reach light receiver 116. Controller 90 may receive the electric signal output from optical sensor 114, the intensity of which depends on the intensity of light 60 received by light receiver 116. Controller 90 may determine whether the value of the electric signal is greater than or equal to the threshold value. When the intensity of light 60 received by light receiver 116 is strong, the level of the electric signal may be greater than or equal to the threshold value. Therefore, controller 90 may determine that the signal is the HI level signal. When controller 90 determines that the signal output from light receiver 116 is the HI level signal, controller may determine that there is no ink left in ink chamber 36 of ink cartridge 30 or that ink cartridge 30 needs to be replaced. Coil spring 73 is not depicted in FIG. 13.

According to the first embodiment, because light transmissive member 70, which is configured to open and close ink supply opening 71 selectively, comprises first inclined surface 82 and second inclined surface 81, an optical detection may be performed at the exit for ink supply in ink cartridge 30. Therefore, the ink amount stored in the ink cartridge 30 may be determined when the ink amount is about zero.

An optical element of ink cartridge 30 does not need to be positioned relative to optical sensor 114 independently of the positioning of ink supply opening 71 relative to ink introduction tube 122. Thus, when ink supply opening 71 is disposed relative to ink introduction tube 122, light transmissive member 70, as an optical element, may be disposed relative to optical sensor 114 at the same time. Therefore, the positioning of ink cartridge 30 relative to cartridge mounting portion 110 may readily be performed.

Because the wall of ink introduction tube 122 is configured to allow light 60 to pass therethrough, the path of light 60 may be formed in the wall of ink introduction tube 122. Therefore, the possibility that air exists in the path of light 60 may be reduced, and, thus, the determination of ink amount becomes more accurate.

Because first inclined surface 82 and second inclined surface 81 are arranged in the vertical direction with first inclined surface 82 disposed below second inclined surface 81, when a portion of first inclined surface 82, where light 60 reflected totally on second inclined surface 81 reaches, stops contacting ink, first inclined surface 82 may reflect totally light 60 toward light receiver 116. Because light 60 reflected totally by first inclined surface 82 passes through the lower portion of ink introduction tube 122, when the ink surface 59 in the ink path 44 is lowered to a level adjacent to the most bottom end of the lower portion of ink supply tube 122, controller 90 may determine that there is no ink left in ink chamber 36 of ink cartridge 30. Therefore, it is possible to determine the ink amount stored in ink cartridge 30 when the ink amount is about zero and just before air flows into ink path 124 of ink introduction tube 122.

When ink introduction tube 122 is inserted into ink supply opening 71, light transmissive member 70 biased by coil spring 73 may contact the end of ink introduction tube 122 securely. Therefore, the possibility that air exists in the path of light 60 may be reduced, and the determination of ink amount becomes more accurate.

In another embodiment, light receiver 116 may be disposed above light emitter 115. In another embodiment, first inclined surface 82 and second inclined surface 81 may be arranged in a direction parallel to a horizontal plane. When first inclined surface 82 and second inclined surface 81 are arranged in a direction parallel to the horizontal plane, light emitter 115 and light receiver 116 also may be arranged in a direction parallel to the horizontal plane. In this case, if optical sensor 114 is positioned, such that the path of light 60 is disposed above ink introduction opening 129 formed at the lower portion of the ink introduction tube 122, light 60 emitted by light emitter 115 toward end surface 130 of recess 126 may come back to light receiver 116 through the wall of ink introduction tube 122 and light transmissive member 70, without passing through ink introduction opening 129. Therefore, the possibility that air exists in the path of light 60 may be reduced, and the determination of ink amount becomes more accurate.

In another embodiment, light 60 emitted by light emitter 115 may pass through ink path 124 of ink introduction tube 122 and may reach light transmissive member 70, without passing through the wall of ink introduction tube 122. Similarly, light 60 reflected by light transmissive member 70 may pass through ink path 124 of ink introduction tube 122 and may reach light receiver 116. In this case, ink introduction tube 122 may not be made of a material which allows light to pass therethrough.

In another embodiment, second inclined surface 81 may reflect light regardless of whether or not the second reflective surface 81 contacts ink. For example, aluminum foil may be applied to second reflective surface 81. Even with this second reflective surface 81, because the first reflective surface 82, which has different reflectances depending on whether or not the first reflective surface 82 contacts ink, is positioned below the second reflective surface 81, it is possible to determine the ink amount stored in the ink cartridge 30 when the ink amount is about zero.

Figure 14A:
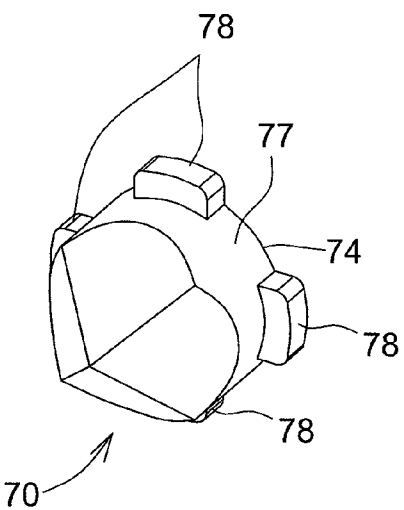
FIG. 14A is a perspective view of a light transmissive member according to another embodiment of the present invention.
Figure 14B:
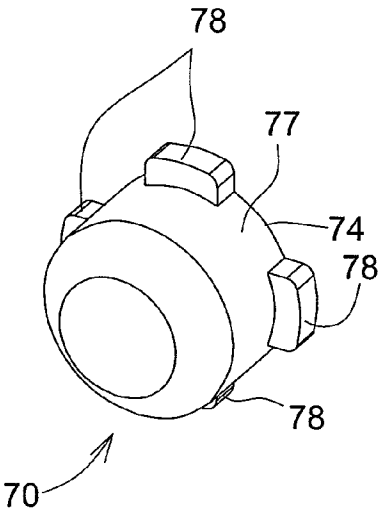
FIG. 14B is a perspective view of a light transmissive member according to still another embodiment of the present invention.
Figure 14C:
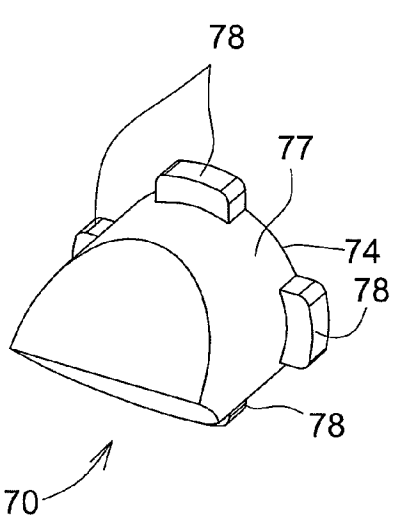
FIG. 14C is a perspective view of a light transmissive member according to yet another embodiment of the invention.
Figure 14D:
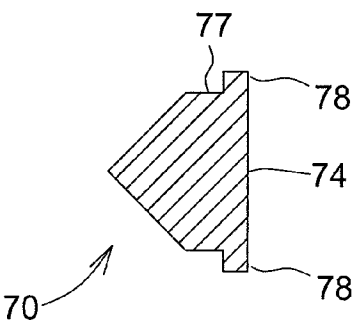
FIG. 14D is a cross-sectional view of the light transmissive member of FIG. 14A.
Figure 14E:
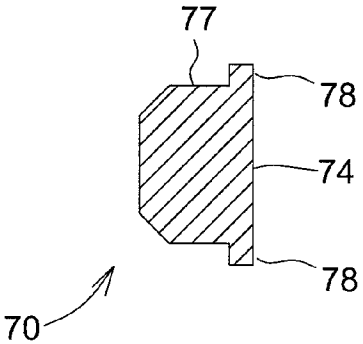
FIG. 14E is a cross-sectional view of the light transmissive member of FIG. 14B.
Figure 14F:
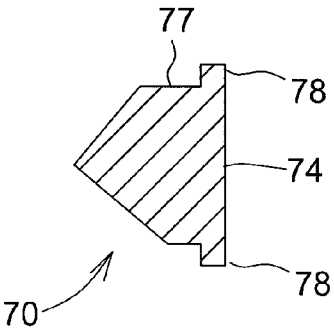
FIG. 14F is a cross-sectional view of the light transmissive member of FIG. 14C.
Figure 15B:
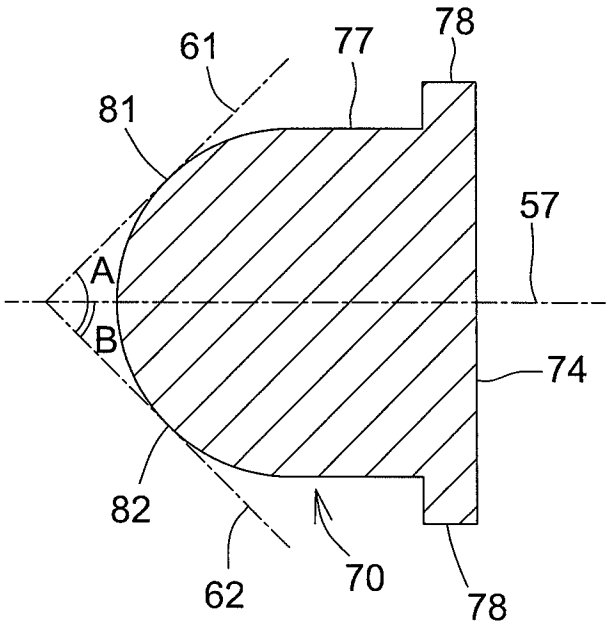
FIG. 15B is a cross-sectional view of the light transmissive member of FIG. 15A.
Figure 15A:
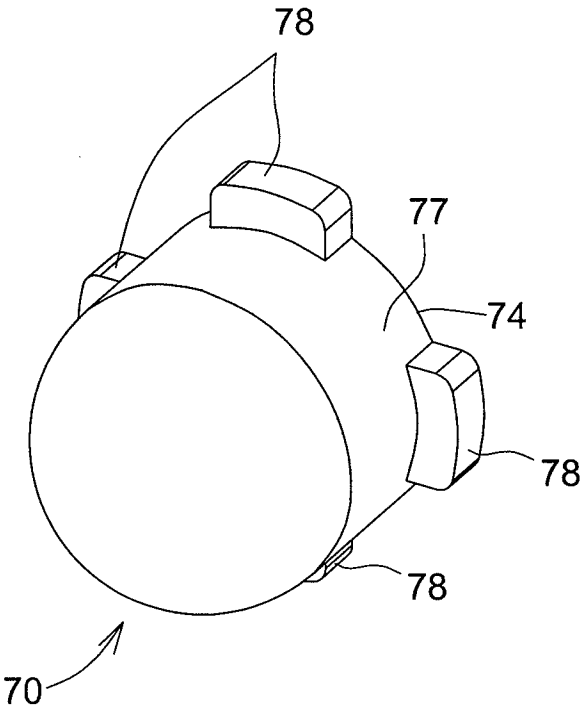
FIG. 15A is a perspective view of a light transmissive member according to still yet another embodiment of the invention.
Figure 16:
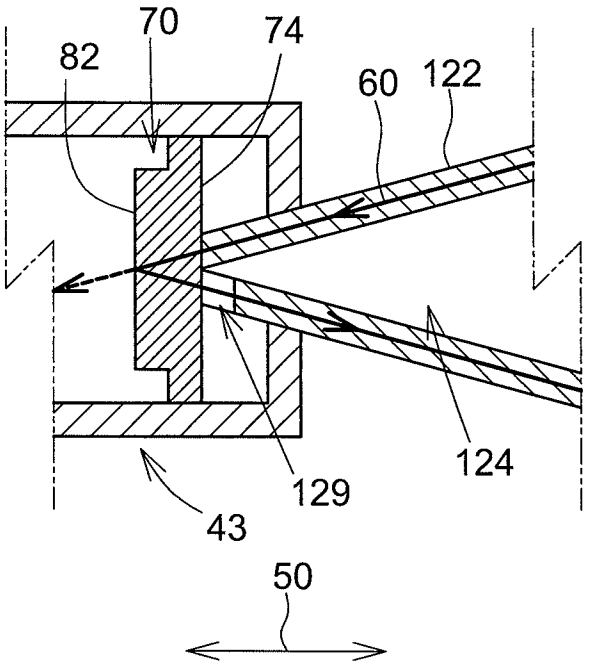
FIG. 16 is a vertical, cross-sectional view of a light transmissive member and a ink introduction tube according to a further embodiment of the invention.

In another embodiment, first inclined surface 82 and second inclined surface 81 may be formed by a different shape of light transmissive member 70 than the cone shape. For example, referring to FIGS. 14A to 14F, instead of cone portion 75, light transmissive member 70 may comprise a pyramid shape portion, as depicted in FIGS. 14A and 14D, a cone shape portion whose vertex portion is cut out, as depicted in FIGS. 14B and 14E, or a tapered shape comprising two planar surfaces having a horizontal edge line, as depicted in FIGS. 14C and 14F. These shapes may comprise first inclined surface 82 and second inclined surface 81. Further, the shape of light transmissive member 70 may be an asymmetrical shape, as depicted in FIGS. 14C and 14F.

In another embodiment, in the cross section of light transmissive member 70 taken along center line 57 and parallel to height direction 52 and depth direction 53, first inclined surface 82 and second inclined surface 81 may form curved lines. For example, referring to FIGS. 15A and 15B, light transmissive member 70 may comprise a dome shape portion instead of cone portion 75, and first inclined surface 82 and second inclined surface 81 may form curved lines in the cross-section.

When first inclined surface 82 and second inclined surface 81 are curved lines in the cross-section, angle B may be an acute angle formed between a tangent line 62 of first inclined surface 82 and center line 57 and angle A may be an acute angle formed between a tangent line 61 of second inclined surface 81 and center line 57. Angle A and angle B may satisfy the afore-mentioned conditions 1 to 3.

In another embodiment, light transmissive member 70 may comprise one inclined surface 82. For example, referring to FIG. 16, light transmissive member 70 may have a flat plate shape, and first inclined surface 82 may be parallel to planar surface 74. In this case, ink introduction tube 122 may have a tapered shape with a diameter of its distal end portion less than a diameter of its base portion. Light 60 may pass through the wall of ink introduction tube 122 in a direction inclined to insertion/removal direction 50. When first inclined surface 82 contacts ink, light 60 may pass through light transmissive member 70 and may reach the ink. When first inclined surface 82 does not contact ink, light 60 may be reflected on the first inclined surface 82 and may pass through the wall of ink introduction tube 122 in a direction inclined to insertion/removal direction 50. Coil spring 73 is not depicted in FIG. 16.

Figure 17:
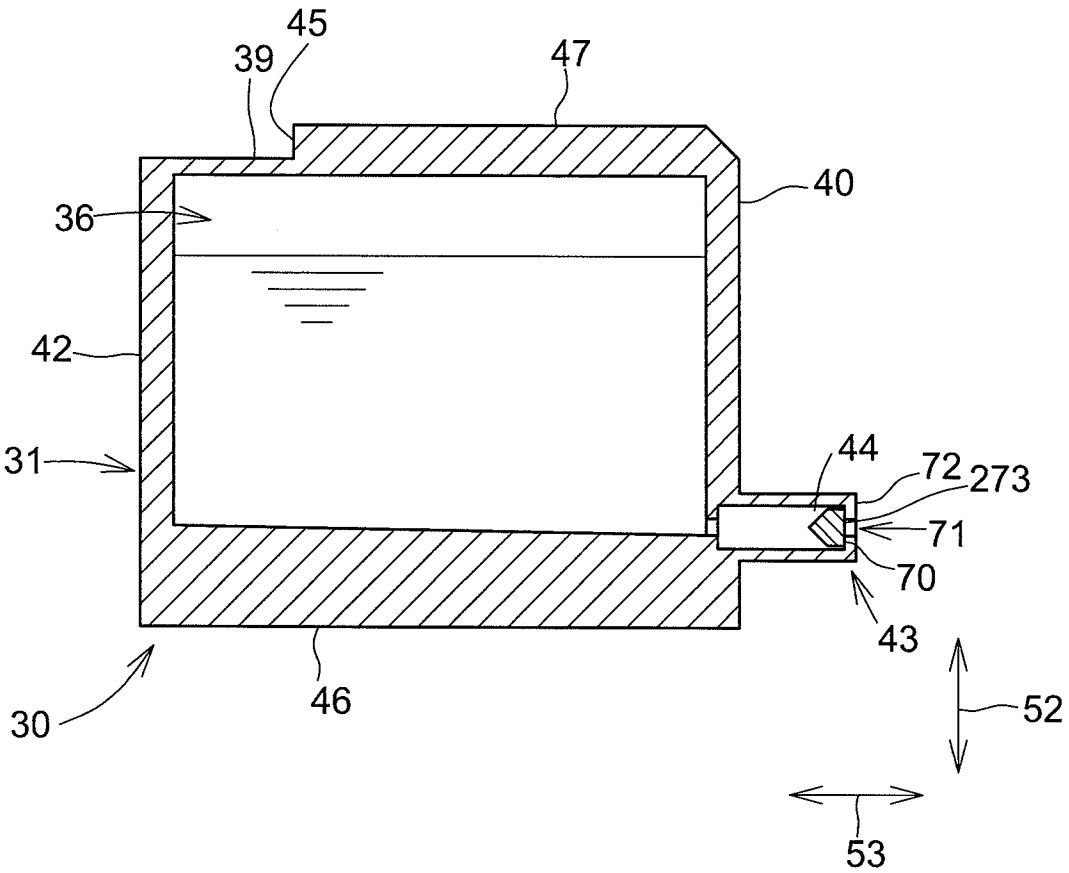
FIG. 17 is a vertical, cross-sectional view of an ink cartridge according to another embodiment of the present invention.
Figure 18:
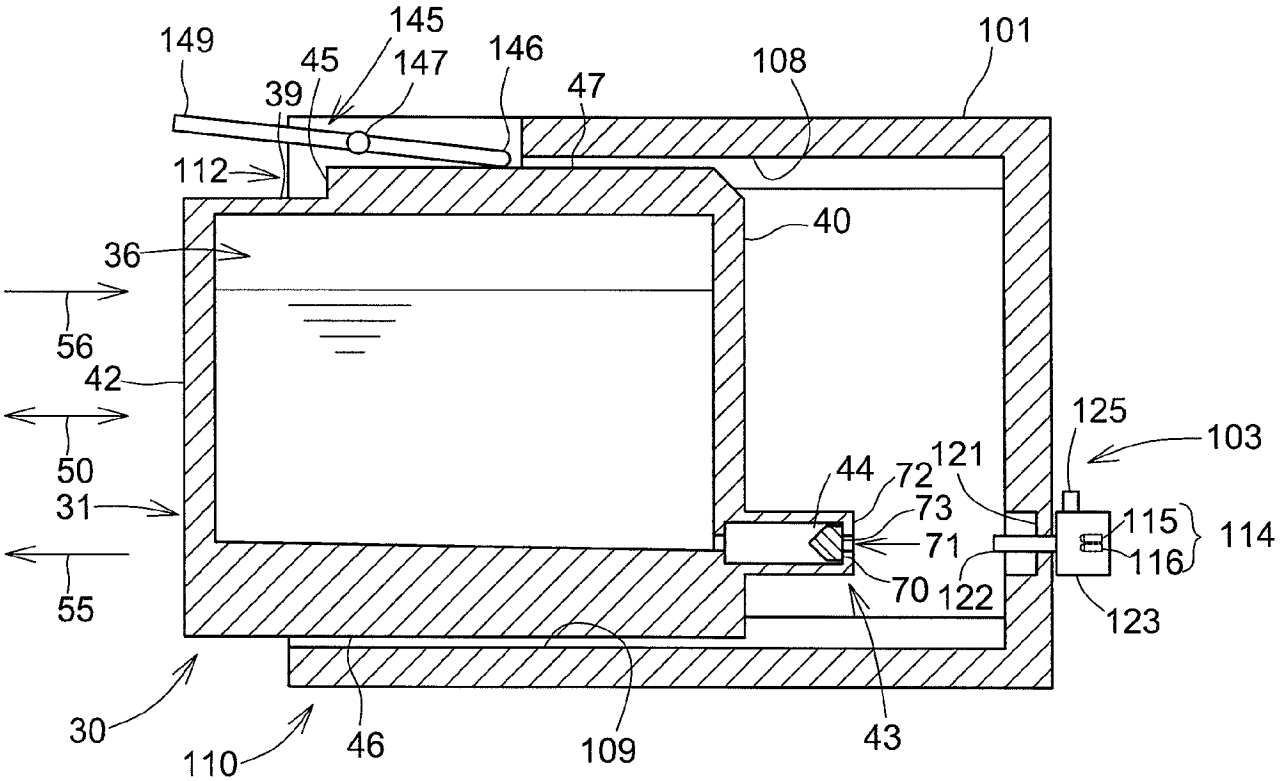
FIG. 18 is a vertical, cross-sectional view of the ink cartridge and a cartridge mounting portion according to another embodiment of the present invention during insertion of the ink cartridge into the cartridge mounting portion.
Figure 19:
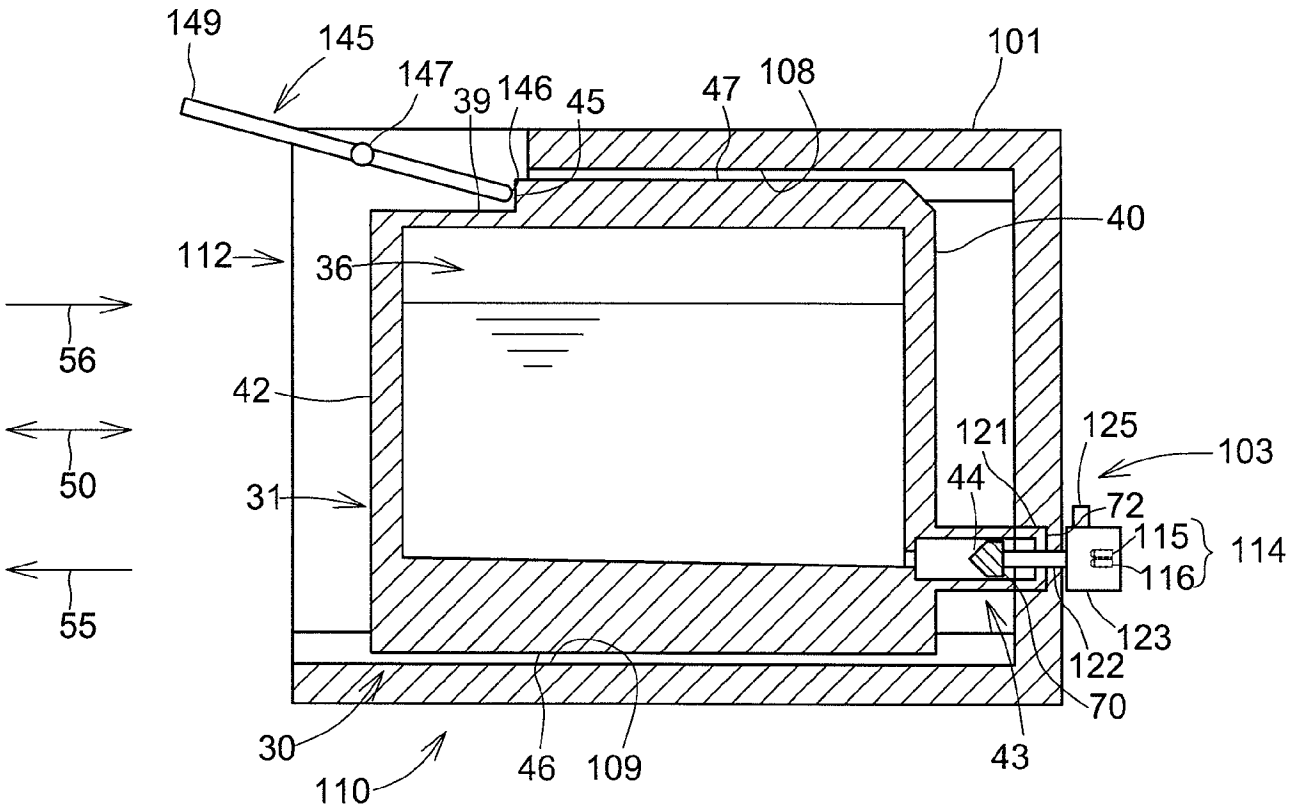
FIG. 19 is a vertical cross-sectional view of the ink cartridge and the cartridge mounting portion when the ink cartridge is in a mounted position in the cartridge mounting portion.

FIGS. 17-19 depict a second embodiment and other embodiments of the present invention. In the second embodiment, ink cartridge 30 may comprise a film 273 in place of coil spring 73.

Referring to FIG. 17, film 273 may be adhered to end 72 of ink supply portion 43 from the inside to cover ink supply opening 71, such that ink supply opening 71 is closed. Film 273 may be configured to be broken by ink introduction tube 122 when ink introduction tube 122 is inserted through ink supply opening 71. When ink cartridge 30 is not mounted to cartridge mounting portion 110, light transmissive member 70 may be in a first position adjacent to ink supply opening 71.

Referring to FIGS. 18 and 19, when ink cartridge 30 is inserted into cartridge mounting portion 110, ink introduction tube 122 may be inserted through ink supply opening 71, and the end of ink introduction tube 122 may contact film 273. When ink cartridge 30 is inserted further, the end of ink introduction tube 122 may break film 273 and may enter ink path 44. The end of ink introduction tube 122 may then contact planar surface 74 of light transmissive member 70 in the first position. When ink cartridge 30 is inserted further, the ink introduction tube 122 may move light transmissive member 70 from the first position to a second position which is away from ink supply opening 71. Because ink introduction opening 129 is formed at the end of ink introduction tube 122, ink may be supplied from ink chamber 33 via ink path 44 and ink introduction opening 129 into ink path 124 of ink introduction tube 122.

In another embodiment, light transmissive member 70 may be immovably fixed to the wall of ink supply portion 43. Ink introduction tube 122 may not contact planar surface 74 of light transmissive member 70, and there may be some gap between the end of ink introduction tube 122 and planar surface 74 when ink cartridge 30 is mounted to cartridge mounting portion 110.

In another embodiment, end 72 of ink supply portion 43 may comprise a resilient member, e.g., rubber, and ink supply opening 71 may be formed through the resilient member in depth direction 53, e.g., insertion/removal direction 50. When ink cartridge 30 is not mounted to cartridge mounting portion 110, ink supply opening 71 may be closed by the resiliency of the resilient member. When ink cartridge 30 is inserted into cartridge mounting portion 110, ink introduction tube 122 may be inserted through ink supply opening 71 and ink introduction tube 122 may push through the resilient member and open ink supply opening 71. When ink cartridge 30 is mounted to cartridge mounting portion 110, the resilient member may be deformed resiliently and may contact tightly the outer surface of ink introduction tube 122.

FIGS. 20-26B depict a third embodiment and other embodiments of the present invention. In the third embodiment, light transmissive member 70 of ink cartridge 30 may be replaced by a valve 70, which may or may not be light transmissive. Ink introduction tube 122 may comprise a first inclined surface 382 and a second inclined surface 381.

Figure 20:
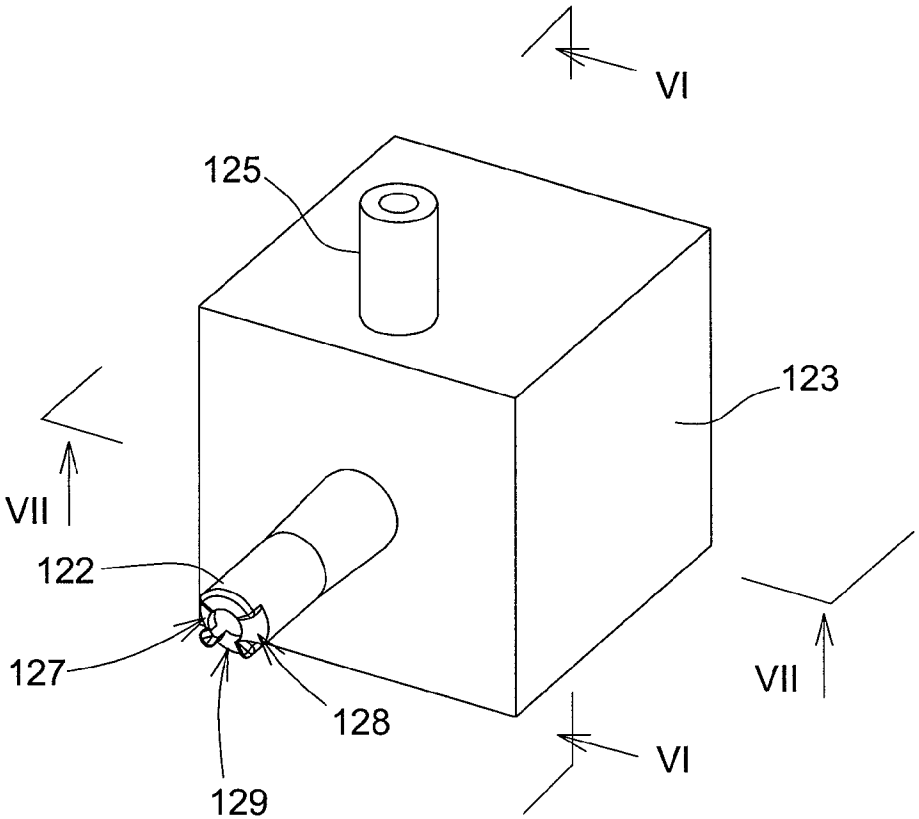
FIG. 20 is a perspective view of an ink introduction tube according to still another embodiment of the present invention.
Figure 21:
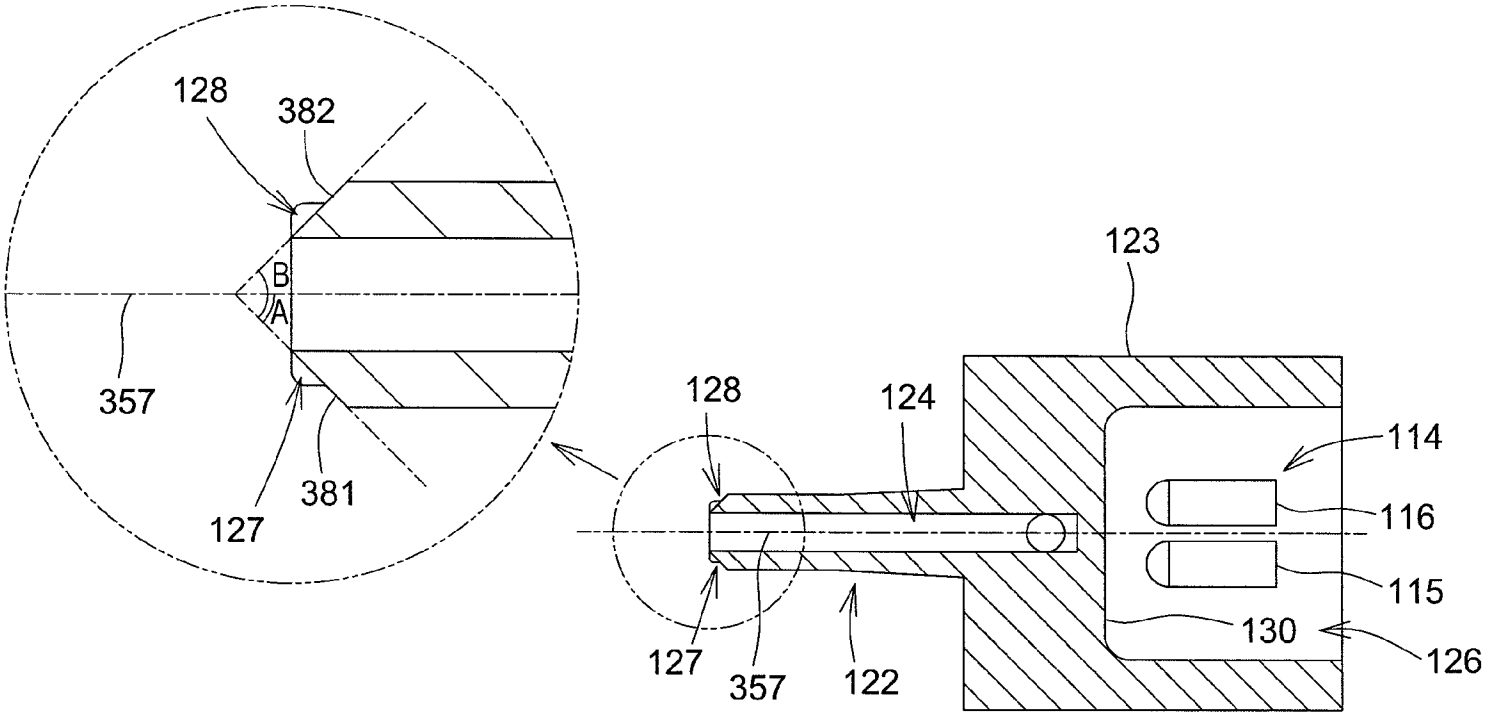
FIG. 21 is a cross-sectional view of the ink introduction tube taken along the line VIII-VIII of FIG. 20.
Figure 22:
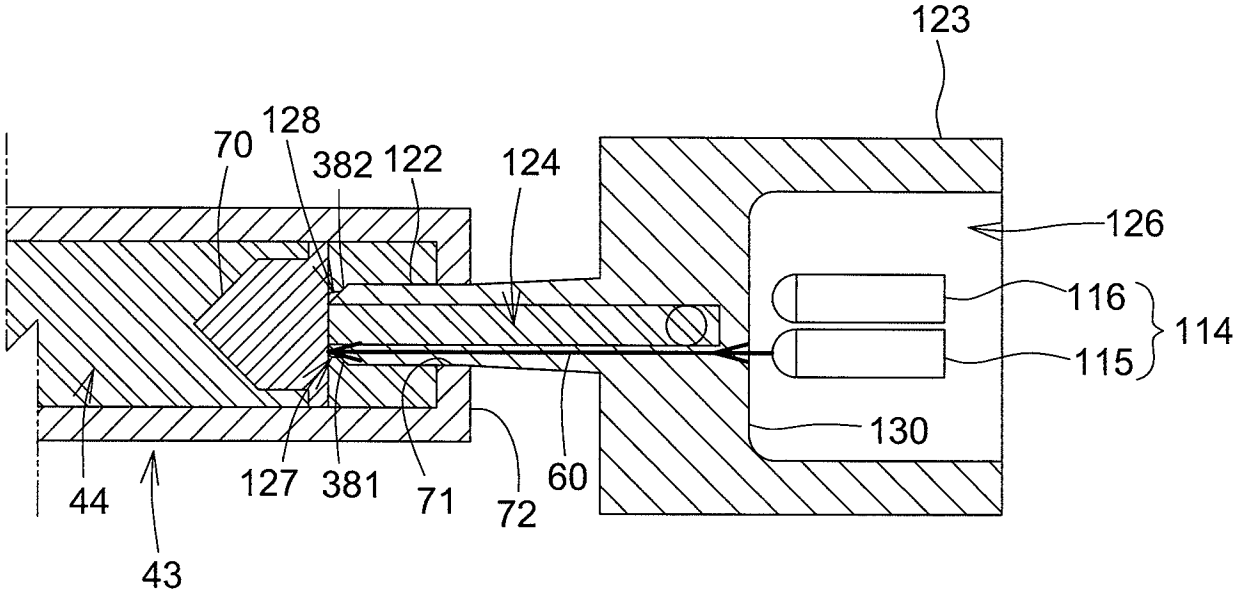
FIG. 22 is a horizontal, cross-sectional view of an ink supply portion of an ink cartridge according to the still another embodiment of the present invention and the ink introduction tube, depicting a light path when an ink path of the ink cartridge is filled with ink.
Figure 23:
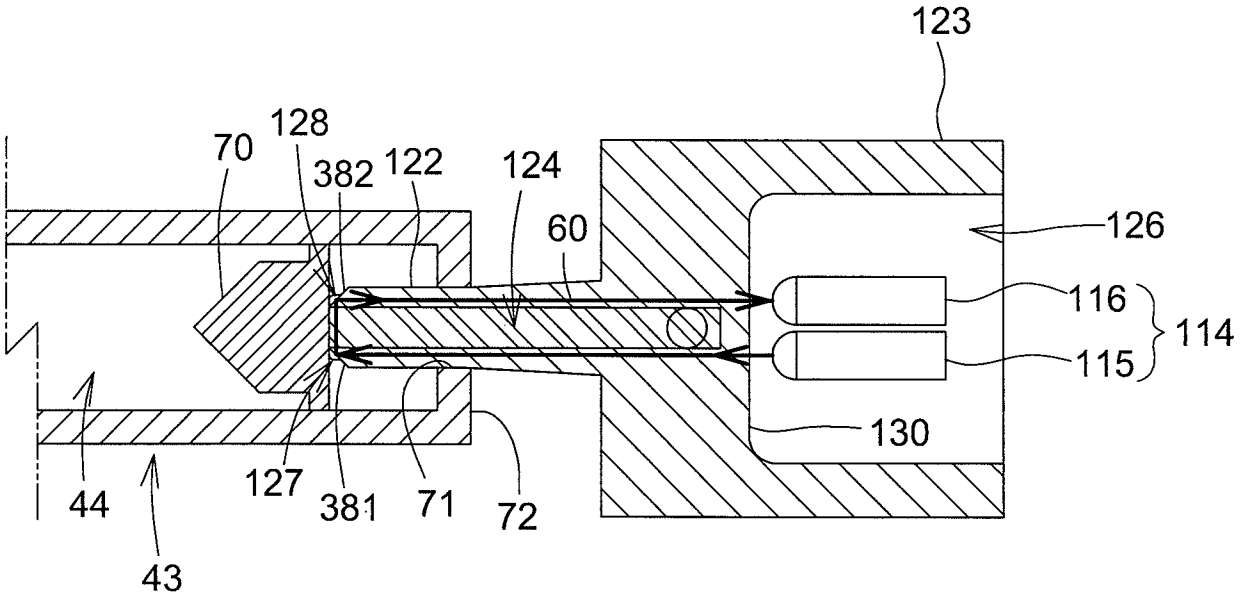
FIG. 23 is a horizontal, cross-sectional view of the ink supply portion and the ink introduction tube, depicting a light path when the ink surface in the ink path has lowered.

Referring to FIGS. 20 and 21, ink introduction opening 129 may be formed at an end of ink introduction tube 122 farthest from connector 123. The exterior of ink introduction tube 122 may be in fluid communication with ink path 124 via ink introduction opening 129. Ink introduction opening 129 may be formed at a lower side of the end of ink introduction tube 122. Ink introduction opening 129 may be formed by a recess or a cut out in the wall of ink introduction tube 122 from the end of ink introduction tube 122 toward connector 123 in insertion/removal direction 50. When the end of ink introduction tube 122 contacts valve 70, ink may be supplied into the inner space of ink introduction tube 122, e.g., into ink path 124 via ink introduction opening 129. Cut-outs 127 and 128 may be formed at the end of ink introduction tube 122. Cut-outs 127 and 128 may be provided on both sides of the end of ink introduction tube 122 in a horizontal direction. Each of cut-outs 127 and 128 may be formed by a recess or a cut out in the outer wall surface of ink introduction tube 122 from the end of ink introduction tube 122 toward connector 123 in insertion/removal direction 50. First inclined surface 382 and second inclined surface 381 may be formed by cut-outs 128 and 127. Referring to FIGS. 22 and 23, when the end of ink introduction tube 122 contacts valve 70, the inner side ends of first inclined surface 382 and second inclined surface 381 may contact the valve 70. Therefore, ink may not flow into ink path 124 formed in ink introduction tube 122 via cut-outs 127 and 128.

Ink introduction tube 122 may have a center line 357 in its axial direction, which is parallel with insertion/removal direction 50. The cross section of ink introduction tube 122, as depicted in FIG. 21, is a horizontal cross section taken along center line 357 in insertion/removal direction 50. In this cross section, first inclined surface 382 may be formed on the outer surface of ink introduction tube 122 by cut-out 128, and second inclined surface 381 may be formed on the outer surface of ink introduction tube 122 by cut-out 127. Center line 357 may be positioned between first inclined surface 382 and second inclined surface 381. Second inclined surface 381 may be offset from first inclined surface 382 in a direction perpendicular to center line 357. First inclined surface 382 and second inclined surface 381 may be arranged in a horizontal direction. Each of first inclined surface 382 and second inclined surface 381 may incline toward center line 357. In the cross section as depicted in FIG. 21, each of first inclined surface 382 and second inclined surface 381 may form a straight line.

First inclined surface 382 may form an acute angle B with center line 357. Second inclined surface 381 may form an acute angle A with center line 357. Angles A and B may satisfy the following conditions:

angle $A$+angle $B$=90 degrees; Condition 1:

angle $A$>$SIN^{-1}$ ((absolute refractive index of air)/(absolute refractive index of the ink introduction tube 122)); and Condition 2:

angle $B$>$SIN^{-1}$ ((absolute refractive index of air)/(absolute refractive index of the ink introduction tube 122)). Condition 3.

Each of first inclined surface 382 and second inclined surface 381 may have a first reflectance R1 for light passing through the wall of ink introduction tube 122 when contacting ink stored in ink chamber 36 and a second reflectance R2 for light passing through the wall of ink introduction tube 122 when not contacting ink stored in ink chamber 36. First reflectance R1 may be different from second reflectance R2. For example, when first inclined surface 382 or second inclined surface 381 has first reflectance R1, most of the light passing through ink introduction tube 122 in insertion/removal direction 50, e.g., axial direction of ink introduction tube 122, may pass through first inclined surface 382 or second inclined surface 381 to the ink chamber 36 side. When first inclined surface 382 or second inclined surface 381 has second reflectance R2, light passing through ink introduction tube 122 in insertion/removal direction 50, e.g., the axial direction of ink introduction tube 122, may be reflected totally on first inclined surface 382 or second inclined surface 381. Reflectances R1 and R2 may be realized by angles A and B that satisfy the above conditions 2 and 3. Because angles A and B satisfy the above condition 1, when light travelling in insertion/removal direction 50 is reflected totally on first inclined surface 382 and second inclined surface 381, the reflected light may travel in insertion/removal direction 50. Thus, first inclined surface 382 and second inclined surface 381 may cause light travelling in removal direction 55 to be reflected in insertion direction 56.

Referring to FIGS. 21-23, optical sensor 114 may be disposed in recess 126 of connector 123. Light emitter 115 and light receiver 116 may be arranged in a horizontal direction with center line 357 positioned therebetween. Light emitter 115 may be configured to emit light, e.g., visible or infrared light, via end surface 130 of recess 126 towards second inclined surface 381 of ink introduction tube 122 in insertion/removal direction 50. Light receiver 116 may be configured to receive light coming from first inclined surface 382 of ink introduction tube 122 and reaching end surface 130.

Referring to FIG. 22, light 60 emitted by light emitter 115 of optical sensor 114 may pass through the wall of ink introduction tube 122 in insertion/removal direction 50 and may reach second inclined surface 381. Ink path 44 formed in ink supply portion 43 may be filled with ink stored in ink chamber 36, such that second inclined surface 381 contacts the ink. Coil spring 73 is not depicted in FIG. 22.

Because second inclined surface 381 contacts ink, second inclined surface 381 may allow light 60 emitted by light emitter 115 and passing through the wall of ink introduction tube 122 to pass therethrough to reach the ink, such that almost no light 60 may reach light receiver 116. Controller 90 may receive the electric signal output from optical sensor 114, the intensity of which depends on the intensity of light 60 received by light receiver 116. Controller 90 may determine whether the value of the electric signal is greater than or equal to the threshold value. Because the intensity of light 60 received by light receiver 116 is very weak or about zero, the value of the electric signal is less than the threshold value. Therefore, controller 90 may determine that the signal is the LOW level signal. When the controller 90 determines that the signal output from light receiver 116 is the LOW level signal, controller 90 may determine that there is sufficient ink left in ink chamber 36 of ink cartridge 30 or that it is not necessary to replace ink cartridge 30.

As the printer 10 performs printing, ink stored in ink chamber 36 in ink cartridge 30 may be consumed. When the amount of ink stored in ink chamber 36 becomes small, an ink surface in ink path 44 may be lowered. When ink surface is lower than cut-outs 127 and 128 of ink introduction tube 122, first inclined surface 382 and second inclined surface 381 may not contact ink.

Referring to FIG. 23, because second inclined surface 381 does not contact ink, second inclined surface 381 may reflect totally light 60 emitted by light emitter 115 and passing through the wall of ink introduction tube 122. Light 60 reflected totally on second inclined surface 381 may pass through ink path 124 towards first inclined surface 382.

Because first inclined surface 382 does not contact ink, first inclined surface 382 may reflect totally light 60 which has been totally reflected on second inclined surface 381. Light 60 reflected totally on first inclined surface 382 may pass through the wall of light introduction tube 122 toward light receiver 116 in insertion/removal direction 50, and may reach light receiver 116. Controller 90 may receive the electric signal output from optical sensor 114, the intensity of which depends on the intensity of light 60 received by light receiver 116. Controller 90 may determine whether the value of the electric signal is greater than or equal to the threshold value. Because the intensity of light 60 received by light receiver 116 is strong, the value of the electric signal may be greater than or equal to the threshold value. Therefore, controller 90 may determine that the signal is the HI level signal. When controller 90 determines that the signal output from light receiver 116 is the HI level signal, controller may determine that there is no ink left in ink chamber 36 of ink cartridge 30 or that ink cartridge 30 must be replaced. Coil spring 73 is not depicted in FIG. 23.

According to the third embodiment, because ink introduction tube 122, which is configured to be inserted through ink supply opening 71, comprises first inclined surface 382 and second inclined surface 381, an optical detection may be performed at the exit for ink supply in ink cartridge 30. Therefore, the ink amount stored in ink cartridge 30 may be determined when the ink amount is about zero.

An optical element of ink cartridge 30 need not be disposed relative to optical sensor 114 independently of the disposition of ink supply opening 71 relative to ink introduction tube 122. Therefore, the disposition of ink cartridge 30 relative to the cartridge mounting portion 110 may be performed readily.

Because the wall of ink introduction tube 122 is configured to allow light 60 to pass therethrough, the path of light 60 may be formed in the wall of ink introduction tube 122. Therefore, the possibility that air exists in the path of light 60 may be reduced, and, thus, the determination of ink amount becomes more accurate.

Figure 24B:
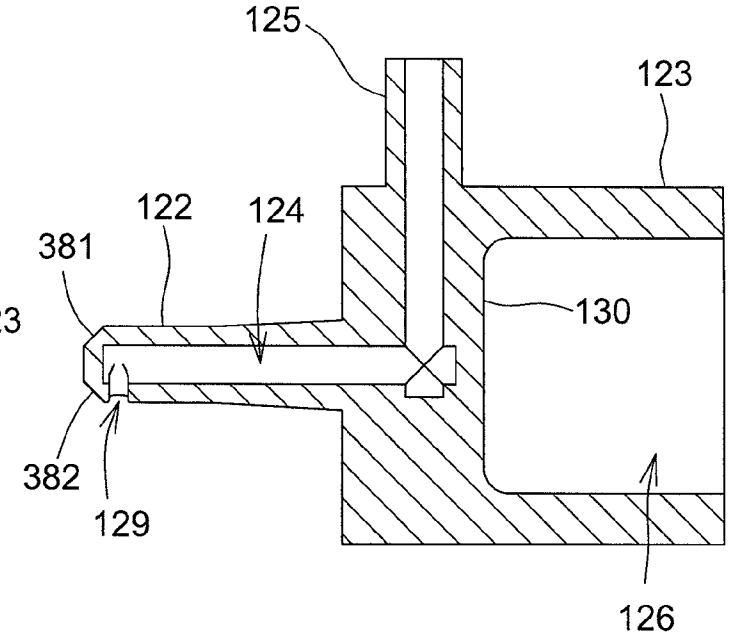
FIG. 24B is a vertical, cross-sectional view of the ink introduction tube in FIG. 24A.
Figure 24A:
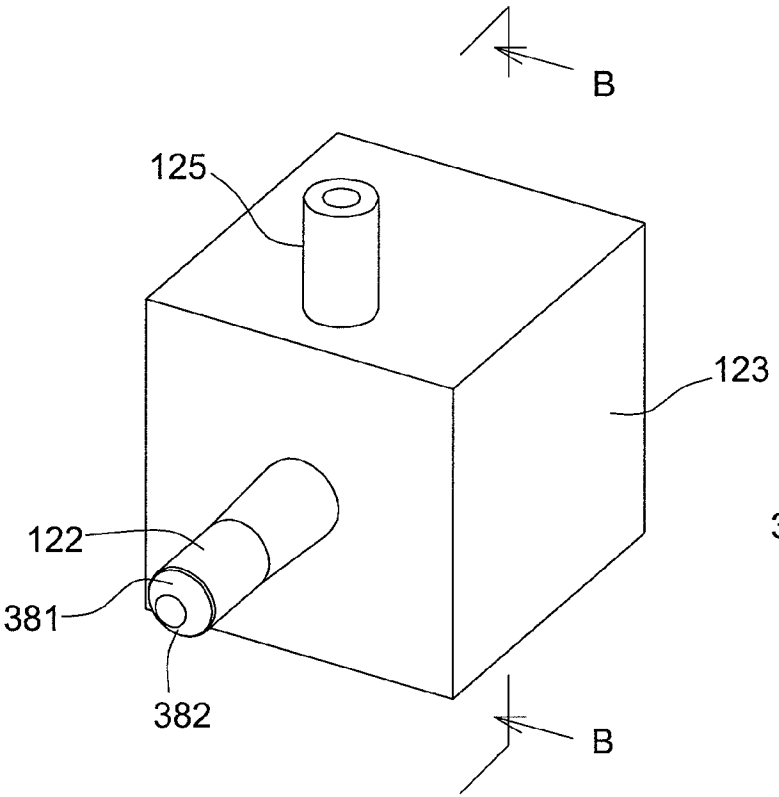
FIG. 24A is a perspective view of an ink introduction tube according to another embodiment of the invention.

In another embodiment, first inclined surface 382 and second inclined surface 381 may be arranged in the vertical direction with first inclined surface 382 disposed below second inclined surface 381. For example, as depicted in FIGS. 24A and 24B, the outer edge of the end of ink introduction tube 122 may be formed into an inclined surface in a ring shape, and a lower portion of the inclined surface may be the first inclined surface 382 and an upper portion of the inclined surface may be the second inclined surface 381. Ink introduction opening 129 may be formed at a lower side of the end of ink introduction tube 122. Ink introduction opening 129 may not be defined by first inclined surface 382 nor second inclined surface 381. Light emitter 115 and light receiver 116 also may be arranged in the vertical direction, and light emitter 115 may be configured to emit light toward second inclined surface 381 through an upper portion of the wall of ink introduction tube 122.

When a portion of first inclined surface 382, where light 60 reflected from second inclined surface 381 is received, stops contacting ink, first inclined surface 382 may reflect totally light 60 toward light receiver 116. Because light 60 reflected totally by first inclined surface 382 passes through a lower portion of ink introduction tube 122, when the ink surface in the ink path 44 is lowered to a level adjacent to the most bottom end of the lower portion of ink supply tube 122, controller 90 may determine that no ink remains in ink chamber 36 of ink cartridge 30. Therefore, the ink amount stored in the ink cartridge 30 may be determined when the ink amount is about zero and just before air flows into ink path 124 of ink introduction tube 122.

Referring to FIGS. 24A and 24B, second inclined surface 381 may reflect light regardless of whether or not the second reflective surface 381 contacts ink. For example, aluminum foil may be applied to second reflective surface 381. Even with this second reflective surface 381, because first reflective surface 382, which may have different reflectances depending on whether or not first reflective surface 382 contacts ink, may be disposed below second reflective surface 381, the ink amount stored in ink cartridge 30 may be determined when the ink amount is about zero.

Figure 25B:
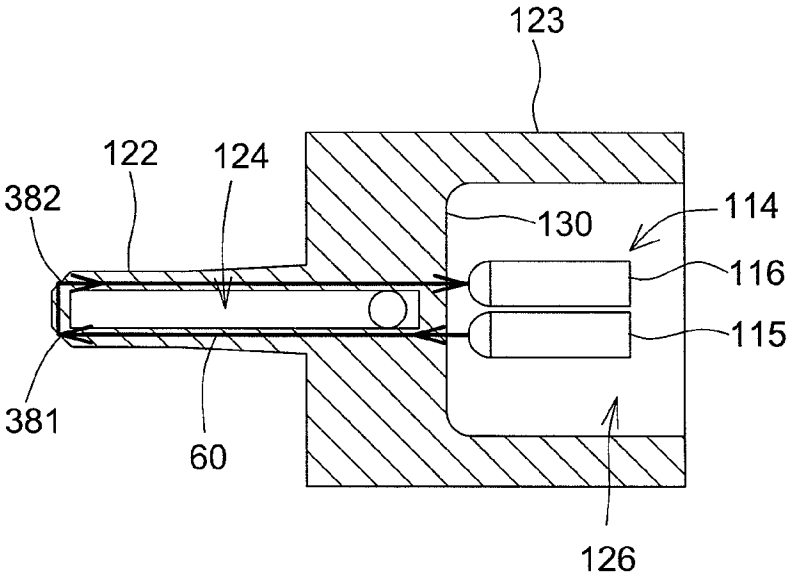
FIG. 25B is a vertical, cross-sectional view of the ink introduction tube in FIG. 25A.
Figure 25A:
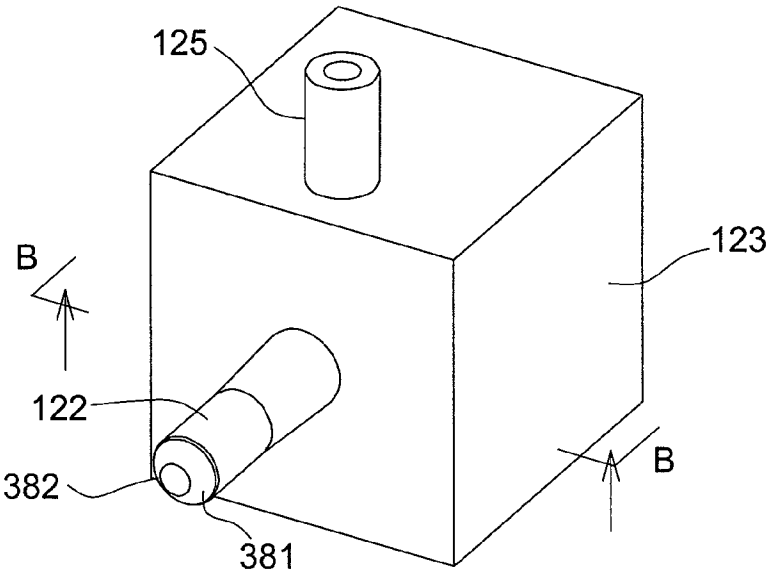
FIG. 25A is a perspective view of an ink introduction tube according to yet another embodiment of the invention.
Figure 26B:
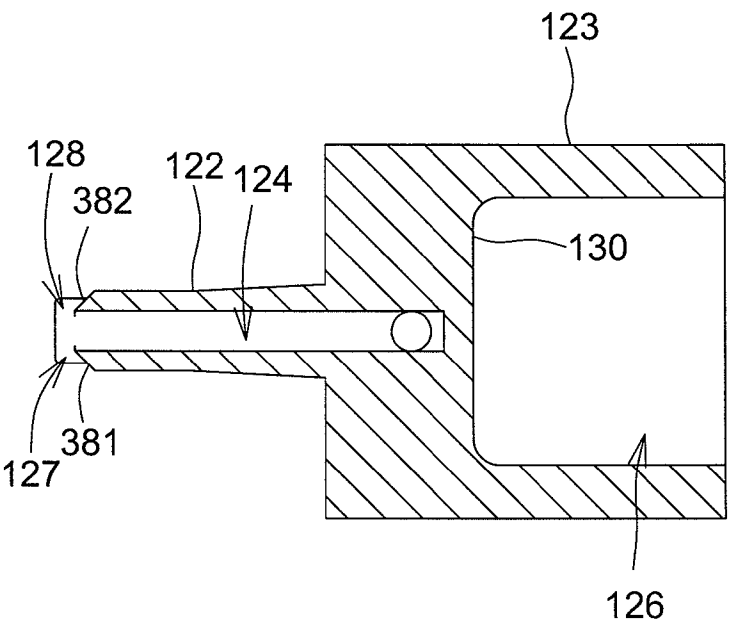
FIG. 26B is a vertical, cross-sectional view of the ink introduction tube in FIG. 26A.
Figure 26A:
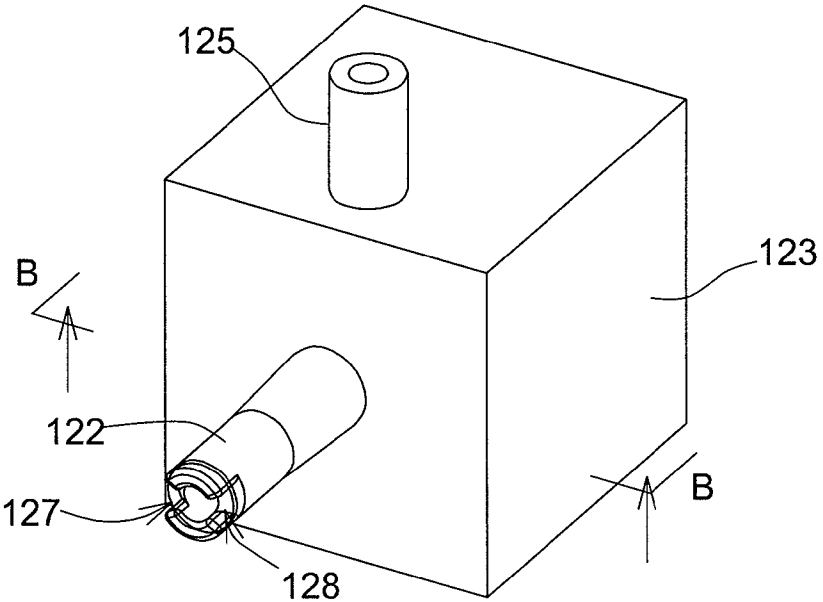
FIG. 26A is a perspective view of an ink introduction tube according to still another embodiment of the invention.

In another embodiment, as depicted in FIGS. 25A and 25B, the outer edge of the end of ink introduction tube 122 may be formed into an inclined surface in a ring shape. Left and right portions of the inclined surface may be the first inclined surface 382 and the second inclined surface 381, respectively. First inclined surface 382 and second inclined surface 381 may be arranged in a direction parallel to a horizontal plane, and light emitter 115 and light receiver 116 also may be arranged in a direction parallel to the horizontal plane. Referring to FIG. 25B, light 60 emitted by light emitter 115 may travel through the wall of ink introduction tube 122 and may reach light receiver 116. Because air does not exist in path of the light 60, the determination of ink amount may become more accurate.

In another embodiment, when the end of ink introduction tube 122 contacts valve 70, first inclined surface 382 and second inclined surface 381 may not contact valve 70. For example, referring to FIGS. 26A and 26B, each of cut-outs 127 and 128 may be formed by a recess or a cut out in the wall of ink introduction tube 122 from the end of ink introduction tube 122 toward connector 123 in insertion/removal direction 50, such that first inclined surface 382 and second inclined surface 381 may not contact valve 70 when the end of ink introduction tube 122 contacts valve 70. Ink may flow into ink path 124 via cut-outs 127 and 128. Thus, cut-outs 127 and 128 may function as ink introduction openings. First inclined surface 382 may define an insertion direction 56 side end of cut-out 128 as an ink introduction opening, and second inclined surface 381 may define an insertion direction 56 side end of cut-out 127 as an ink introduction opening.

In another embodiment, in the horizontal cross-section of ink introduction tube 122 taken along center line 357, first inclined surface 382 and second inclined surface 381 may form curved lines. For example, the end of ink introduction tube 122 may have a dome shape. When first inclined surface 382 and second inclined surface 381 form curved lines in the cross section, angle B may be an acute angle formed between a tangent line of first inclined surface 382 and center line 357 and angle A may be an acute angle formed between a tangent line of second inclined surface 381 and center line 357. Angle A and the angle B may satisfy the afore-mentioned Conditions 1 to 3.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. An ink cartridge comprising:

a case comprising an ink chamber formed in the case, wherein the ink chamber is configured to store ink therein;

an ink supply opening formed in the case, wherein the ink supply opening is opened to an exterior of the case and is configured to allow ink stored in the ink chamber to pass therethrough; and a light transmissive member disposed in the case and facing the ink supply opening, wherein the light transmissive member is configured to allow light entering via the ink supply opening to pass through the light transmissive member, wherein the light transmissive member comprises a particular reflective surface, which has a first reflectance for the light entering via the ink supply opening and passing through the light transmissive member when the particular reflective surface contacts the ink stored in the ink chamber, and which has a second reflectance for the light entering via the ink supply opening and passing through the light transmissive member when the particular reflective surface does not contact the ink stored in the ink chamber, wherein the first reflectance is different from the second reflectance.

2. The ink cartridge of claim 1, wherein the light transmissive member faces the ink supply opening in an axial direction of the ink supply opening, and the particular reflective surface is inclined with respect to the axial direction of the ink supply opening, wherein the light transmissive member comprises a further reflective surface inclined with respect to the axial direction of the ink supply opening and offset from the particular reflective surface in a direction perpendicular to the axial direction of the ink supply opening, and wherein the further reflective surface is configured to reflect the light entering via the ink supply opening and passing through the light transmissive member toward the particular reflective surface or toward the ink supply opening at least when the further reflective surface does not contact the ink stored in the ink chamber.

3. The ink cartridge of claim 2, wherein the ink cartridge is configured to be inserted into a cartridge mounting portion in a horizontal insertion direction and mounted to the cartridge mounting portion, and the particular reflective surface and the further reflective surface are arranged in a horizontal direction.

4. The ink cartridge of claim 2, wherein the ink cartridge is configured to be inserted into a cartridge mounting portion in a horizontal insertion direction and mounted to the cartridge mounting portion, and the particular reflective surface and the further reflective surface are arranged in a vertical direction perpendicular to the horizontal insertion direction, wherein the particular reflective surface is positioned below the further reflective surface in the vertical direction, and wherein the further reflective surface is configured to reflect the light entering via the ink supply opening and passing through the light transmissive member toward the particular reflective surface or toward the ink supply opening when the further reflective surface contacts the ink stored in the ink chamber and when the further reflective surface does not contact the ink stored in the ink chamber.

5. The ink cartridge of claim 1, wherein the light transmissive member is a valve configured to move selectively toward and away from the ink supply opening in a moving direction, wherein the light transmissive member is movable between an open position and a close position, wherein, when the light transmissive member is in the open position, the ink supply opening is exposed by the light transmissive member, and, when the light transmissive member is in the close position, the ink supply opening is covered by the light transmissive member, and wherein the ink cartridge further comprises a biasing member configured to bias the light transmissive member toward the ink supply opening to position the light transmissive member in the close position.

6. The ink cartridge of claim 5, wherein the particular reflective surface is inclined with respect to the moving direction of the light transmissive member, wherein the light transmissive member comprises a further reflective surface inclined with respect to the moving direction and offset from the particular reflective surface in a direction perpendicular to the moving direction, wherein the further reflective surface is configured to reflect the light entering via the ink supply opening and passing through the light transmissive member toward the particular reflective surface or toward the ink supply opening at least when the further reflective surface does not contact the ink stored in the ink chamber.

7. The ink cartridge of claim 6, wherein the ink cartridge is configured to be inserted into a cartridge mounting portion in a horizontal insertion direction and mounted to the cartridge mounting portion, and the particular reflective surface and the further reflective surface are arranged in a horizontal direction.

8. The ink cartridge of claim 6, wherein the ink cartridge is configured to be inserted into a cartridge mounting portion in a horizontal insertion direction and mounted to the cartridge mounting portion, and the particular reflective surface and the further reflective surface are arranged in a vertical direction perpendicular to the horizontal insertion direction, wherein the particular reflective surface is positioned below the further reflective surface in the vertical direction, and wherein the further reflective surface is configured to reflect the light entering via the ink supply opening and passing through the light transmissive member toward the particular reflective surface or toward the ink supply opening when the further reflective surface contacts the ink stored in the ink chamber and when the further reflective surface does not contact the ink stored in the ink chamber.

9. An ink supply device comprising the ink cartridge of claim 5 and a cartridge mounting portion, wherein the ink cartridge is configured to be inserted into the cartridge mounting portion in an insertion direction and mounted to the cartridge mounting portion, wherein the ink supply opening is formed in a front face of the case in the insertion direction, and the moving direction of the light transmissive member is parallel to the insertion direction, wherein the cartridge mounting portion comprises:

an ink introduction tube configured to be inserted through the ink supply opening and to move the light transmissive member from the close position to the open position against a biasing force of the biasing member during insertion of the ink cartridge into the cartridge mounting portion;

a light emitter configured to emit light toward the light transmissive member via the ink supply opening; and a light receiver configured to receive the light emitted from the light emitter and reflected by the light transmissive member.

10. The ink supply system of claim 9, wherein the light emitter is configured to emit the light toward the light transmissive member when the ink introduction tube is inserted through the ink supply opening.

11. The ink supply system of claim 9, wherein the ink introduction tube comprises a wall configured to allow the light emitted by the light emitter to pass therethrough, and wherein the light emitter is configured to emit the light toward the light transmissive member through the wall of the ink introduction tube, and the light receiver is configured to receive the light reflected by the light transmissive member through the wall of the ink introduction tube.

12. The ink supply system of any one of claim 9, wherein the light emitter is configured to emit the light in a direction parallel to the insertion direction, wherein the particular reflective surface is inclined with respect to the insertion direction, wherein the light transmissive member comprises a further reflective surface inclined with respect to the insertion direction and offset from the particular reflective surface in a direction perpendicular to the insertion direction, and wherein the further reflective surface is configured to reflect the light emitted by the light emitter and passing through the light transmissive member toward the particular reflective surface or the light receiver when the further reflective surface does not contact the ink stored in the ink chamber.

13. The ink supply system of claim 12, wherein the insertion direction is parallel to a horizontal plane, and the particular reflective surface and the further reflective surface are arranged in a direction parallel to the horizontal plane.

14. The ink cartridge of claim 12, wherein the insertion direction is a horizontal direction, and the particular reflective surface and the further reflective surface are arranged in a vertical direction perpendicular to the horizontal direction, wherein the particular reflective surface is positioned below the further reflective surface in the vertical direction, and wherein the further reflective surface is configured to reflect the light emitted by the light emitter and passing through the light transmissive member toward the particular reflective surface or toward the light receiver when the further reflective surface contacts the ink stored in the ink chamber.

15. An ink supply device comprising the ink cartridge of claim 1 and a cartridge mounting portion, wherein the ink cartridge is configured to be inserted into the cartridge mounting portion in an insertion direction and mounted to the cartridge mounting portion, wherein the ink supply opening is formed in a front face of the case in the insertion direction, and the light transmissive member faces the ink supply opening in the insertion direction, wherein the cartridge mounting portion comprises:

an ink introduction tube configured to be inserted through the ink supply opening during insertion of the ink cartridge into the cartridge mounting portion;

a light emitter configured to emit light towards the light transmissive member via the ink supply opening; and a light receiver configured to receive the light emitted by the light emitter and reflected by the light transmissive member.

16. The ink supply system of claim 15, wherein the light emitter is configured to emit the light toward the light transmissive member when the ink introduction tube is inserted through the ink supply opening.

17. The ink supply system of claim 15, wherein the ink introduction tube comprises a wall configured to allow the light emitted by the light emitter to pass therethrough, wherein the light emitter is configured to emit the light toward the light transmissive member through the wall of the ink introduction tube, and the light receiver is configured to receive the light reflected by the light transmissive member through the wall of the ink introduction tube.

18. The ink supply system of claim 15, wherein the light emitter is configured to emit the light in a direction parallel to the insertion direction, wherein the particular reflective surface is inclined with respect to the insertion direction, wherein the light transmissive member comprises a further reflective surface inclined with respect to the insertion direction and offset from the particular reflective surface in a direction perpendicular to the insertion direction, wherein the further reflective surface is configured to reflect the light emitted by the light emitter and passing through the light transmissive member toward the particular reflective surface or toward the light receiver at least when the further reflective surface does not contact the ink stored in the ink chamber.

19. The ink supply system of claim 18, wherein the insertion direction is parallel to a horizontal plane, and the particular reflective surface and the further reflective surface are arranged in a direction parallel to the horizontal plane.

20. The ink cartridge of claim 18, wherein the insertion direction is a horizontal direction, and the particular reflective surface and the further reflective surface are arranged in a vertical direction perpendicular to the horizontal direction, wherein the particular reflective surface is positioned below the further reflective surface in the vertical direction, and wherein the further reflective surface is configured to reflect the light emitted by the light emitter and passing through the light transmissive member toward the particular reflective surface or toward the light receiver when the further reflective surface contacts the ink stored in the ink chamber and when the further reflective surface does not contact the ink stored in the ink chamber.

21. An ink supply device comprising:

an ink cartridge; and a cartridge mounting portion, wherein the ink cartridge is configured to be inserted into the cartridge mounting portion in an insertion direction and mounted to the cartridge mounting portion, wherein the ink cartridge comprises:

a case comprising an ink chamber formed in the case, wherein the ink chamber is configured to store ink therein; and an ink supply opening formed in a front face of the case in the insertion direction, wherein the ink supply opening is configured to allow ink stored in the ink chamber to pass therethrough, wherein the cartridge mounting portion comprises:

an ink introduction tube comprising a wall configured to allow light to pass therethrough, wherein an end portion of the ink introduction tube is configured to be inserted through the ink supply opening during insertion of the ink cartridge into the cartridge mounting portion, and the end portion comprises a particular reflective surface;

a light emitter configured to emit light towards the particular reflective surface through the wall of the ink introduction tube; and a light receiver configured to receive the light emitted by the light emitter and reflected by the particular reflective surface through the wall of the ink introduction tube, wherein the particular reflective surface has a first reflectance for the light emitted by the light emitter and passing through the wall of the ink introduction tube when the particular reflective surface contacts the ink stored in the ink chamber, and has a second reflectance for the light emitted by the light emitter and passing through the wall of the ink introduction tube when the particular reflective surface does not contact the ink stored in the ink chamber, and wherein the first reflectance is different from the second reflectance.

22. The ink supply device of claim 21, wherein the ink introduction tube has an ink introduction opening extending from an end of the ink introduction tube in the insertion direction, and the particular reflective surface defines an insertion direction-side end of the ink introduction opening.

23. The ink supply device of claim 21 wherein the ink introduction tube comprises a further reflective surface configured to reflect the light emitted by the light emitter and passing through the wall of the ink introduction tube towards the particular reflective surface or towards the light receiver at least when the further reflective surface does not contact the ink stored in the ink chamber.

24. The ink supply device of claim 23, wherein the insertion direction is parallel to a horizontal plane, and the particular reflective surface and further second reflective surface are arranged in a direction parallel to the horizontal plane.

25. The ink supply device of claim 23, wherein the insertion direction is a horizontal direction, and the particular reflective surface and the further reflective surface are arranged in a vertical direction perpendicular to the horizontal direction, wherein the particular reflective surface is disposed below the further reflective surface in the vertical direction, wherein the further reflective surface is configured to reflect the light emitted by the light emitter and passing through the wall of the ink introduction tube toward the particular reflective surface or toward the light receiver when the further reflective surface contacts the ink stored in the ink chamber and when the further reflective surface does not contact the ink stored in the ink chamber.

* * * * *